US011377813B2

(12) United States Patent
Nakano et al.

(10) Patent No.: US 11,377,813 B2
(45) Date of Patent: Jul. 5, 2022

(54) WORK MACHINE WITH SEMI-AUTOMATIC EXCAVATION AND SHAPING

(71) Applicant: HITACHI CONSTRUCTION MACHINERY CO., LTD., Tokyo (JP)

(72) Inventors: Hisami Nakano, Tsuchiura (JP); Hiroaki Tanaka, Kasumigaura (JP); Yusuke Suzuki, Tsuchiura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 187 days.

(21) Appl. No.: 16/645,501

(22) PCT Filed: Sep. 20, 2018

(86) PCT No.: PCT/JP2018/034896
§ 371 (c)(1),
(2) Date: Mar. 9, 2020

(87) PCT Pub. No.: WO2020/059094
PCT Pub. Date: Mar. 26, 2020

(65) Prior Publication Data
US 2021/0148081 A1 May 20, 2021

(51) Int. Cl.
*E02F 9/22* (2006.01)
*E02F 3/43* (2006.01)
*E02F 9/26* (2006.01)

(52) U.S. Cl.
CPC ..... *E02F 3/431* (2013.01); *E02F 9/2228* (2013.01); *E02F 9/2267* (2013.01); *E02F 9/2278* (2013.01); *E02F 9/264* (2013.01)

(58) Field of Classification Search
CPC ..... E02F 9/2278; E02F 9/262; E02F 9/265; E02F 9/2221; E02F 9/2271
See application file for complete search history.

(56) References Cited

U.S. PATENT DOCUMENTS 7,532,967 B2 * 5/2009 Fujishima ..... E02F 9/2045 37/341
8,838,329 B2 * 9/2014 Seki ..... E02F 9/261 701/33.1

(Continued)

FOREIGN PATENT DOCUMENTS

EP 0790355 A1 * 8/1997 ..... E02F 3/437
JP 2000-192514 A 7/2000

(Continued)

OTHER PUBLICATIONS

International Search Report of PCT/JP2018/034896 dated Oct. 16, 2018.

(Continued)

*Primary Examiner* — Thomas E Lazo
(74) *Attorney, Agent, or Firm* — Mattingly & Malur, PC

(57) ABSTRACT

In a work machine including a controller (500) configured to calculate respective target velocities of a hydraulic cylinder (5) for moving a plurality of work point candidates (8*a* and 8*b*) set to a work device along an optionally set target surface (60) on the basis of positional data of the target surface, posture data of the work device (15), and operation data of an operation lever (1), and control the velocity of the hydraulic cylinder (5) according to one of a plurality of the calculated target velocities, the controller calculates a candidate point velocity (VTab or VTba) occurring in a case where each of the plurality of work point candidates is moved at the corresponding target velocity (VTa or VTb) and occurring at a remaining work point candidate, selects a velocity at which an entry into the target surface is least likely from among the plurality of candidate point velocities, and controls the hydraulic cylinder according to the target velocity of the work point candidate associated with the selected candidate point velocity.

5 Claims, 17 Drawing Sheets

(56) References Cited

U.S. PATENT DOCUMENTS

| | | | | |
|---|---|---|---|---|
| 9,020,709 | B2 * | 4/2015 | Matsuyama | E02F 3/30 701/51 |
| 9,080,317 | B2 * | 7/2015 | Matsuyama | E02F 3/437 |
| 9,551,129 | B2 * | 1/2017 | Kami | E02F 9/265 |
| 2016/0251835 | A1 * | 9/2016 | Kitajima | E02F 3/32 701/50 |
| 2016/0273186 | A1 | 9/2016 | Kami et al. | |
| 2017/0342679 | A1 | 11/2017 | Iwamura et al. | |

FOREIGN PATENT DOCUMENTS

| | | | |
|---|---|---|---|
| JP | 2016-003442 | A | 1/2016 |
| WO | 2012/127914 | A1 | 9/2012 |
| WO | 2015/181990 | A1 | 12/2015 |
| WO | 2016/186219 | A1 | 11/2016 |

OTHER PUBLICATIONS

International Preliminary Report on Patentability received in corresponding International Application No. PCT/JP2018/034896 dated Apr. 1, 2021.

* cited by examiner

| RELATION BETWEEN INPUT VALUES | OUTPUT |
|---|---|
| CANDIDATE POINT VELOCITY VTab > CANDIDATE POINT VELOCITY VTba | a |
| CANDIDATE POINT VELOCITY VTab < CANDIDATE POINT VELOCITY VTba | b |

FIG. 14

| RELATION BETWEEN INPUT VALUES | OUTPUT |
|---|---|
| "MINIMUM VALUE OF CANDIDATE POINT VELOCITY c-GROUP" IS MAXIMUM AMONG CANDIDATE POINT VELOCITY GROUPS | c |
| "MINIMUM VALUE OF CANDIDATE POINT VELOCITY d-GROUP" IS MAXIMUM AMONG CANDIDATE POINT VELOCITY GROUPS | d |
| "MINIMUM VALUE OF CANDIDATE POINT VELOCITY e-GROUP" IS MAXIMUM AMONG CANDIDATE POINT VELOCITY GROUPS | e |
| "MINIMUM VALUE OF CANDIDATE POINT VELOCITY f-GROUP" IS MAXIMUM AMONG CANDIDATE POINT VELOCITY GROUPS | f |

WORK MACHINE WITH SEMI-AUTOMATIC EXCAVATION AND SHAPING

TECHNICAL FIELD

The present invention relates to a work machine such as a hydraulic excavator or the like.

BACKGROUND ART

In a field of work machines including hydraulic excavators, a control system is known which, when construction is performed by using a work machine, corrects operation by an operator on a work device (front work device) attached to a work machine on the basis of a distance between the work device and a target surface generated from three-dimensional design data of a construction target, and thereby semiautomatically performs excavation and shaping work appropriate for the target surface by the work device.

In addition, in the excavation and shaping work, it is necessary to prevent not only a tip end of a bucket located at a tip end portion of the work device but also another part of the work device (for example, a bulging part of the back surface of the bucket) from entering the target surface. There is Patent Document 1 in relation to this kind of technology.

In Patent Document 1, first, a bucket tip end is set as a first monitoring point, and a point at an outermost end of a bucket back surface is set as a second monitoring point, a boom cylinder velocity (first adjustment velocity) when the work device (work implement) is controlled such that the first monitoring point does not enter the target surface is set as S1, and a boom cylinder velocity (second adjustment velocity) when the work device is controlled such that the second monitoring point does not enter the target surface is set as S2. Then, the work device is controlled according to the larger of S1 and S2. That is, when S1>S2, the work device is controlled such that the first monitoring point is set as a target and is prevented from entering the target surface. When S2>S1, on the other hand, the work device is controlled such that the second monitoring point is set as a target and is prevented from entering the target surface. When the work device is thus controlled, the bucket tip end and the bucket back surface can be prevented from entering the target surface in leveling work that forms, for example, a substantially horizontal target surface by moving the bucket in a front-rear direction.

PRIOR ART DOCUMENT

Patent Document

Patent Document 1: PCT Patent Publication No. WO 2012/127914

SUMMARY OF THE INVENTION

Problem to be Solved by the Invention

However, although the work machine using a control system described in Patent Document 1 can prevent the bucket from entering the target surface in work in which boom raising operation always separates the bucket from the target surface (for example, leveling work depicted in FIG. 10), the bucket may enter the target surface 60 in work in which boom lowering operation separates the bucket from a target surface 60 as in a positional relation between the work machine depicted in FIG. 11 and the target surface 60, for example.

In relation to this, leveling work will be considered again with reference to FIG. 18, and thereafter a case where a vertical target surface as depicted in FIG. 11 is excavated below a machine body will be considered with reference to FIG. 12. In the present document, points as references for control that prevents an entry into the target surface 60 when the control is performed will be referred to as work points (specifically a bucket tip end 8*a* and a bucket back surface end 8*b*). Incidentally, in order to simplify the consideration, suppose that the bucket tip end 8*a* and the bucket back surface end 8*b* are at a same distance from the target surface 60 in FIGS. 18 and 12 (that is, suppose that a bucket bottom surface connecting the bucket tip end 8*a* and the bucket back surface end 8*b* to each other is parallel with the target surface 60). In addition, as depicted in (a) of FIG. 18, as for the velocity of the bucket tip end 8*a*, a direction of approaching the target surface 60 from above the target surface 60 is defined as negative, and a direction of going away from the target surface 60 is defined as positive. As for cylinder velocity, complying with common definitions in the work machine, an extending direction is defined as positive, and a contracting direction is defined as negative.

In FIG. 18, the tip end 8*a* and the back surface end 8*b* of the bucket are located in front of and in the rear of an imaginary surface 61 including an axis of rotation of an arm and perpendicular to the target surface 60. In addition, in FIG. 18 and FIG. 12, in order to simplify the description, attention will be directed only to components perpendicular to the target surface 60 in velocities (velocity vectors (Va1, Vb1, Vtgt, Vmoda, and Vmodb)) occurring at the bucket tip end 8*a* or the bucket back surface end 8*b* by operation of the arm and the boom. That is, while components parallel with the target surface 60 actually occur, the description will be made omitting the components parallel with the target surface 60.

First, description will be made of an operation in a case where the work device is controlled so as to prevent the bucket tip end 8*a* from entering the target surface 60 by bringing an operation target velocity Vtgt of a component of the bucket tip end 8*a* which component is perpendicular to the target surface 60 close to zero as a distance between the bucket tip end 8*a* and the target surface 60 is decreased in (a) depicted on the upper side of FIG. 18. In this case, when the operator performs an arm crowding operation, the arm operates counterclockwise at an angular velocity Wa, as indicated by an outlined arrow in FIG. 18(*a*), and a velocity Va1 in the positive direction occurs at the bucket tip end 8*a*. The operation target velocity (only the perpendicular component) of the bucket tip end 8*a* is Vtgt, and this Vtgt is determined by the distance between the bucket tip end 8*a* and the target surface 60. In order to operate the bucket tip end 8*a* at Vtgt, a correction velocity Vmoda (=Vtgt−Va1) in the negative direction needs to be generated at the bucket tip end 8*a* by a boom operation. Letting Cbm1 be a boom cylinder velocity that generates Vmoda at the bucket tip end, the direction of the cylinder velocity Cbm1 is the contracting direction (that is, negative).

Next, description will be made of an operation in a case where the work device is controlled so as to prevent the bucket back surface end 8*b* from entering the target surface 60 in (b) depicted on the lower side of FIG. 18. The arm operates as in the case of the bucket tip end 8*a*, and operates counterclockwise at the angular velocity Wa. At this time, a velocity Vb1 in the negative direction occurs at the bucket back surface end 8*b*. The operation target velocity of the bucket back surface end 8*b* is similarly Vtgt because the distances of the bucket tip end 8*a* and the bucket back surface end 8*b* from the target surface 60 are the same. In order to operate the bucket back surface end 8*b* at Vtgt, a correction velocity Vmodb (=Vtgt−Vb1) in the positive direction needs to be generated by the boom. Letting Cbm2 be a boom cylinder velocity that generates Vmodb at the bucket back surface end 8*b*, the direction of the cylinder velocity Cbm2 is the extending direction of the cylinder (that is, positive).

The extending direction of the cylinder velocity is defined as positive, and the contracting direction of the cylinder velocity is defined as negative. Thus, Cbm2>Cbm1. In this case, according to the control system described in Patent Document 1 which control system compares the two cylinder velocities with each other, and performs control on the basis of the larger of the two cylinder velocities, the work device is controlled for the case of Cbm2, that is, such that the bucket back surface end 8*b* of (b) is set as a target and is prevented from entering the target surface 60. Because Va1 is positive, and Vb1 is negative, the bucket back surface end 8*b* has a possibility of entering the target surface 60. That is, the control system described in Patent Document 1 can perform semiautomatic excavation and shaping while preventing the bucket tip end and the bucket back surface end from entering the target surface.

Incidentally, at this time, when the contracting direction of the boom cylinder is set as the positive direction, and the extending direction of the boom cylinder is set as the negative direction (that is, when the positive and negative signs of the cylinder velocity are reversed), a part that compares the magnitudes of the above-described cylinder velocities with each other selects the bucket tip end 8*a* as a control target, so that semiautomatic excavation and shaping cannot be performed appropriately (that is, the bucket back surface end 8*b* enters the target surface 60). When the positive and negative signs are not defined, the positive and negative signs of Cbm1 and Cbm2 mutually differ, and the determination is not possible when Cbm1 and Cbm2 have a same magnitude.

Next, using (a) depicted on the upper side of FIG. 12, description will be made of an operation when the work device is controlled so as to prevent the bucket tip end 8*a* from entering the target surface 60 in a case where a vertical target surface is excavated below the machine body (case of FIG. 11). In the case where the target surface 60 as depicted in FIG. 12 is excavated below the machine body, an arm operation by the operator which arm operation is necessary for the excavation is a dumping operation. At this time, the arm operates clockwise at an angular velocity Wa, and the operation by the operator generates a velocity Va1 in the negative direction at the bucket tip end 8*a*. An operation target velocity of the bucket tip end is set as Vtgt. Vtgt is determined by the distance between the bucket tip end 8*a* and the target surface 60. In order to operate the bucket tip end at Vtgt, a correction velocity Vmoda (=Vtgt−Va1) in the positive direction needs to be generated by the boom. Letting Cbm1 be a boom cylinder velocity that generates Vmoda at the bucket tip end, the direction of the cylinder velocity Cbm1 is the contracting direction (that is, negative).

Next, using (b) depicted on the lower side of FIG. 12, description will be made of an operation in a case where the work device is controlled so as to prevent the bucket back surface end 8*b* from entering the target surface 60. The arm operates as in the case of the bucket tip end 8*a*, and operates clockwise at the angular velocity Wa. At this time, the operation by the operator generates a velocity Vb1 in the negative direction at the bucket back surface end 8*b*. The operation target velocity of the bucket back surface end 8*b* is similarly Vtgt because the distances of the bucket tip end 8*a* and the bucket back surface end 8*b* from the target surface 60 are the same. In order to operate the bucket back surface end 8*b* at Vtgt, a correction velocity Vmodb (=Vtgt−Vb1) in the positive direction needs to be generated by the boom. Letting Cbm2 be a boom cylinder velocity that generates Vmodb at the bucket back surface end 8*b*, the direction of the cylinder velocity Cbm2 is the contracting direction (that is, negative), as in Cbm1.

When the magnitudes of the velocities Va1 and Vb1 of the bucket tip end 8*a* and the bucket back surface end 8*b* which velocities result from the arm operations are compared with each other with attention given to the signs, Va1<Vb1. Hence, Vmoda>Vmodb as magnitude relation between the correction velocities Vmoda and Vmodb. In the case of the target surface 60 as depicted in FIG. 12, the boom cylinder velocities Cbm1 and Cbm2 are proportional to the correction velocities Vmoda and Vmodb, whereas the boom cylinder velocities Cbm1 and Cbm2 are opposite in sign from the correction velocities Vmoda and Vmodb because the bucket tip end 8*a* and the bucket back surface end 8*b* move away from the target surface 60 as the boom cylinder is contracted. Hence, when the magnitudes of the boom cylinder velocities Cbm1 and Cbm2 associated with the bucket tip end 8*a* and the bucket back surface end 8*b* are compared with each other with attention given to the signs, Cbm1<Cbm2.

In this case, because Va1<Vb1, the bucket tip end 8*a* is more likely to enter the target surface 60 than the bucket back surface end 8*b*, and it is thus preferable to control the work device with the bucket tip end 8*a* set as a target in performing semiautomatic excavation and shaping. However, the control system described in Patent Document 1 controls the work device so as to set the bucket back surface end 8*b* as a target and prevent the bucket back surface end 8*b* from entering the target surface 60 in the situation in which Cbm1<Cbm2 as in FIG. 12. The bucket tip end 8*a* consequently enters the target surface 60.

The present invention has been made in view of the above-described problems. It is an object of the present invention to provide a work machine capable of performing semiautomatic excavation and shaping and capable of preventing a plurality of points on a work device from entering a target surface, the target surface being not only a target surface located at a position from which a work point is separated by boom raising (for example, a horizontal plane) but also a target surface located at a position from which the work point is separated by boom lowering.

Means for Solving the Problem

According to the present invention, in order to achieve the above object, there is provided a work device; a hydraulic cylinder driven by a hydraulic operating oil delivered from a hydraulic pump thereby driving the work device; an operation device that gives instructions on operations of the hydraulic cylinder according to operation by an operator; and a controller configured to calculate respective target velocities of the hydraulic cylinder for moving a plurality of work point candidates along an optionally set target surface, the work point candidates being set to the work device, on a basis of positional data of the target surface, posture data of the work device, and operation data of the operation device, and control a velocity of the hydraulic cylinder according to one of a plurality of the calculated target velocities; wherein the controller: calculates at least one candidate point velocity that occurs at at least one remaining work point candidate among the plurality of work point candidates in a case where each of the plurality of work point candidates is moved at a corresponding target velocity among the plurality of target velocities, creates a plurality of velocity groups by grouping the at least one candidate point velocity for each of the plurality of work point candidates, selects one velocity group from among the plurality of work point candidates, the one velocity group in which all of the plurality of work point candidates are least likely to perform an operation of entering the target surface, and controls the hydraulic cylinder according to a target velocity, among the plurality of target velocities, of a work point candidate associated with the selected one velocity group.

Advantages of the Invention

According to the present invention, also for a target surface located at a position from which the work point is separated by boom lowering, a plurality of points on the work device can be prevented from entering the target surface.

BRIEF DESCRIPTION OF THE DRAWINGS

FIG. 14 is a truth table depicting relation between input values of a candidate point velocity comparing section in the second embodiment of the present invention and resulting output.

MODES FOR CARRYING OUT THE INVENTION

Embodiments of the present invention will hereinafter be described with reference to the drawings.

First Embodiment

Figure 1:
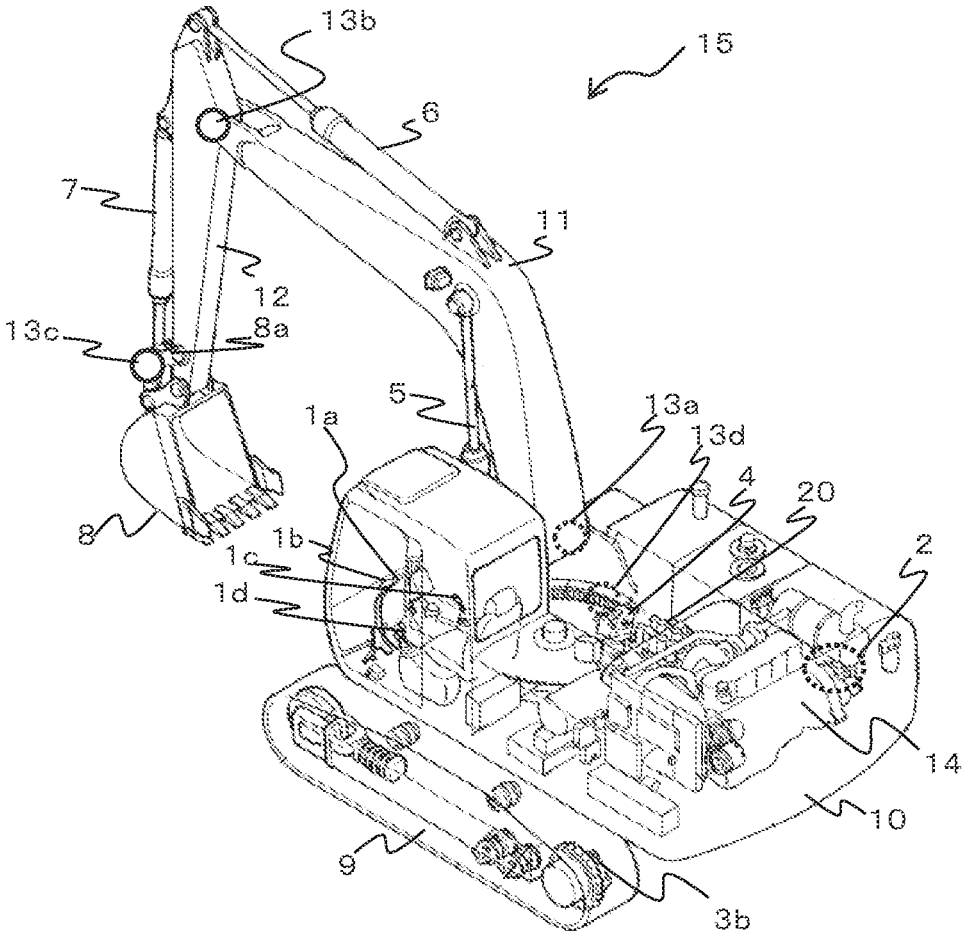
FIG. 1 is a perspective view depicting a work machine in a first and a second embodiments of the present invention.

FIG. 1 is a perspective view depicting a hydraulic excavator according to a first embodiment of the present invention. As depicted in FIG. 1, the hydraulic excavator according to the present embodiment includes a lower travel structure 9 and an upper swing structure 10 as a main body of a machine body and an articulated work device (front work device) 15 attached to the front of the upper swing structure 10.

The lower travel structure 9 has crawler travel devices on a left and a right of the lower travel structure 9, which devices are driven by a left and a right travelling hydraulic motor 3*b* and 3*a* (only 3*b* on the left side is depicted).

The upper swing structure 10 is mounted on the lower travel structure 9 so as to be able to turn left or right. The upper swing structure 10 is turn-driven by a swing hydraulic motor 4. The upper swing structure 10 includes an engine 14 as a prime mover, a hydraulic pump 2 driven by the engine 14, a control valve 20, and a controller 500 (see FIG. 2) in charge of various kinds of control of the hydraulic excavator.

The work device 15 is swingably attached to a front portion of the upper swing structure 10. The work device 15 has an articulated structure having a boom 11, an arm 12, and a bucket 8 as a plurality of swingable front implement members. The boom 11 is swung with respect to the upper swing structure 10 by expansion and contraction of a boom cylinder 5. The arm 12 is swung with respect to the boom 11 by expansion and contraction of an arm cylinder 6. The bucket 8 is swung with respect to the arm 12 by expansion and contraction of a bucket cylinder 7.

Figure 4:
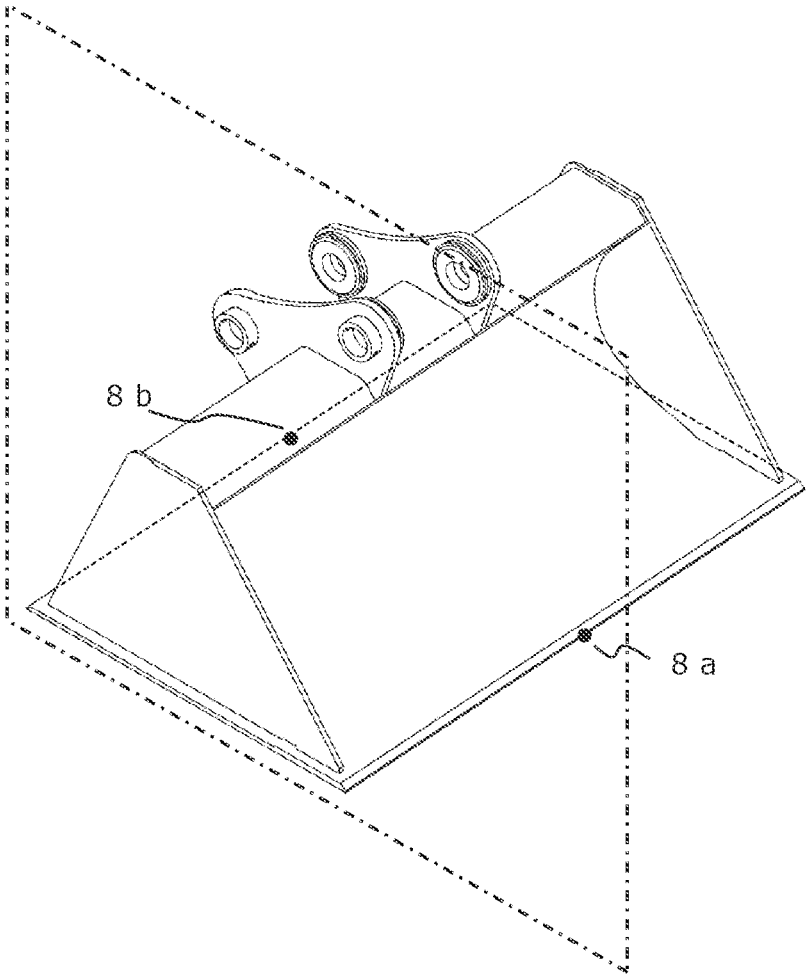
FIG. 4 is a diagram depicting the setting of work point candidates in a first embodiment of the present invention.

FIG. 4 is a perspective view of the bucket 8 in the present embodiment. A bucket tip end 8*a* and a bucket back surface end 8*b* are used as work point candidates set to the work device 15 in the present embodiment. It suffices for the bucket tip end 8*a* to be a point obtained by projecting a tip end edge of the bucket onto a plane perpendicular to the rotational axes of the bucket 8, the arm 12, and the boom 11. It suffices for the bucket back surface end 8*b* to be a point obtained by projecting a back edge of the bucket onto a plane perpendicular to the rotational axis of the bucket. Suppose in the present embodiment that the points are obtained by projecting the bucket edges onto a plane perpendicular to the rotational axis of the bucket and passing through a center of bucket width.

In order to calculate the positions of any points of the work device 15 including the above-described work point candidates (work points) 8*a* and 8*b*, the hydraulic excavator includes: a first posture sensor 13*a* that is disposed in the vicinity of a coupling portion coupling the upper swing structure 10 and the boom 11 to each other, and senses the angle (boom angle) of the boom 11 with respect to a horizontal plane; a second posture sensor 13*b* that is disposed in the vicinity of a coupling portion coupling the boom 11 and the arm 12 to each other, and senses the angle (arm angle) of the arm 12 with respect to the horizontal plane; a third posture sensor 13*c* that is provided to a bucket link 8*a* coupling the arm 12 and the bucket 8 to each other, and senses the angle (bucket angle) of the bucket link 8*a* with respect to the horizontal plane; and a machine body posture sensor 13*d* that senses the angle of inclination (roll angle and pitch angle) of the upper swing structure 10 with respect to the horizontal plane. Incidentally, an IMU (Inertial Measurement Unit: inertia measuring device), for example, can be used as the posture sensors 13*a* to 13*d*. In addition, the first to third posture sensors 13*a* to 13*c* may be sensors sensing a relative angle.

The angles sensed by these posture sensors 13*a* to 13*d* are input as posture signals to an information processing section 100 of the controller 500.

In addition, an operation room is provided to the upper swing structure 10. Arranged within the operation room are operation devices such as a travelling right operation lever device 1*a*, a travelling left operation lever device 1*b*, a right operation lever device 1*c*, and a left operation lever device 1*d*, which are operated by an operator and output an operation signal (electric signal) to the controller 500. The travelling right operation lever device 1*a* is to give an operation instruction to a right travelling hydraulic motor 3*a*. The travelling left operation lever device 1*b* is to give an operation instruction to a left travelling hydraulic motor 3*b*. The right operation lever device 1*c* is to give an operation instruction to the boom cylinder 5 (boom 11) and the bucket cylinder 7 (bucket 8). The left operation lever device 1*d* is to give an operation instruction to the arm cylinder 6 (arm 12) and the swing hydraulic motor 4 (upper swing structure 10). The operation devices 1*a* to 1*d* according to the present embodiment are electric levers. The operation devices 1*a* to 1*d* generate electric signals (operation signals) corresponding to operation amounts, and output the electric signals (operation signals) to the controller 500. Incidentally, the operation devices 1*a* to 1*d* may be of a hydraulic pilot type, and the operation amounts may be sensed by pressure sensors, and input to the controller 500.

The control valve 20 is a valve device including a plurality of spools that control the flow (flow rate and direction) of a hydraulic fluid supplied from the hydraulic pump 2 to each of hydraulic actuators such as the swing hydraulic motor 4, the boom cylinder 5, the arm cylinder 6, the bucket cylinder 7, and the left and right travelling hydraulic motors 3*b* and 3*a* described above. The control valve 20 is driven by driving signals (control valve driving signals) output from the controller 500, and controls the flow (flow rate and direction) of the hydraulic fluid supplied to each of the hydraulic actuators 3 to 7. The driving signals output from the controller 500 are generated on the basis of operation signals (operation data) output from the operation lever devices 1*a* to 1*d*.

—Controller 500—

The controller 500 performs processing of calculating each of target velocities of the hydraulic cylinder (boom cylinder) 5 that moves the plurality of work point candidates 8*a* and 8*b* set to the work device 15 along a target surface 60 on the basis of positional data of the target surface 60 set on a machine body coordinate system by receiving target surface data from a target surface setting device 18, posture data of the work device 15 in the machine body coordinate system, and operation data of an operation lever device 1, and controlling the velocity of the hydraulic cylinder (boom cylinder) 5 according to one of a plurality of the calculated target velocities. Incidentally, in the present embodiment, the velocities of the arm cylinder 6 and the bucket cylinder 7 are controlled on the basis of driving signals output from the operation lever device 1 to the control valve 20.

Figure 2:
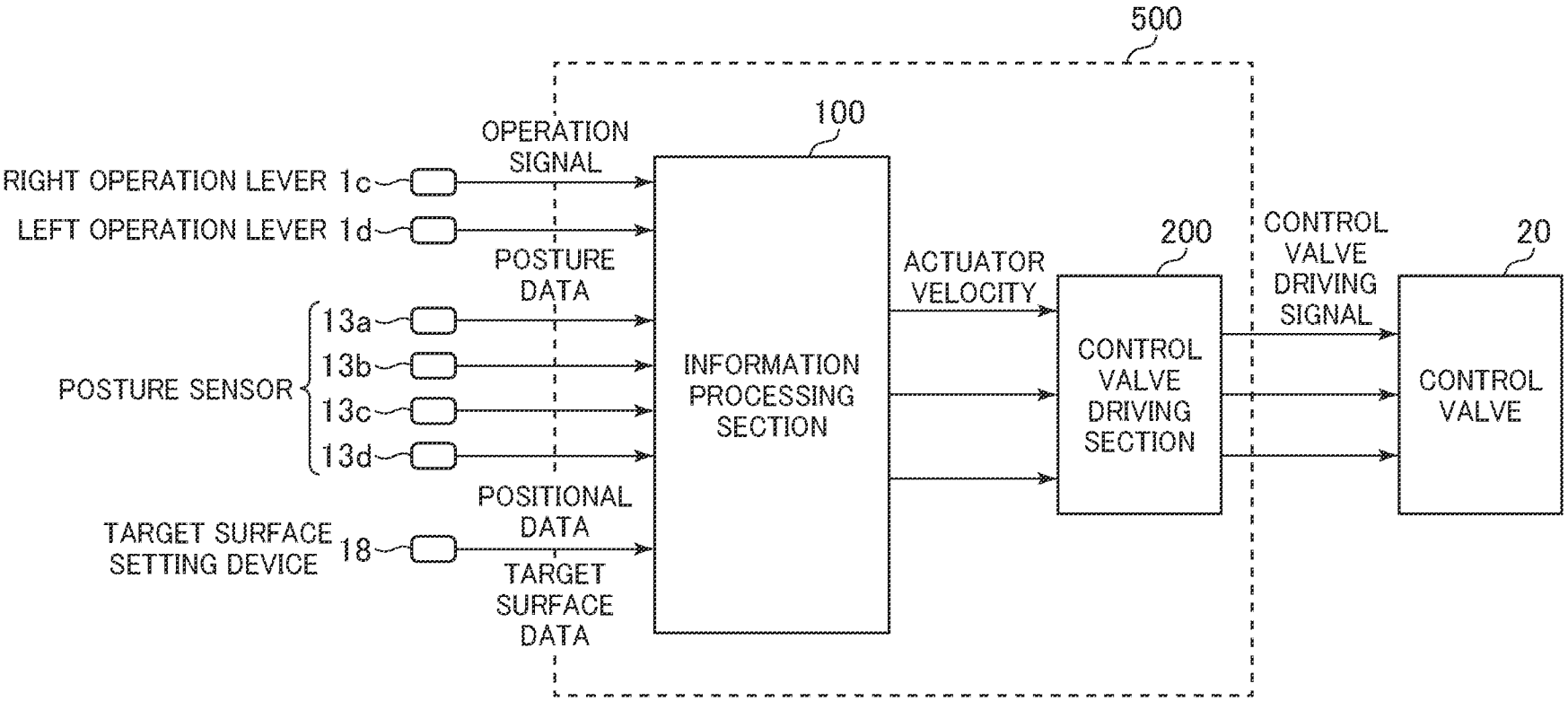
FIG. 2 is a block diagram depicting a control system included in the work machine depicted in FIG. 1.

FIG. 2 is a block diagram of the controller 500 included in the hydraulic excavator of FIG. 1. The controller 500 is, for example, configured by using hardware including a CPU (Central Processing Unit) not depicted, a storage device such as a ROM (Read Only Memory) and an HDD (Hard Disc Drive) storing various kinds of programs for performing processing by the CPU, and a RAM (Random Access Memory) serving as a work area when the CPU executes a program. By thus executing a program stored in the storage device, the controller 500 functions as an information processing section 100 that performs processing of generating a corrected velocity signal when moving the tip end of the work device 15 along the target surface 60 and a control valve driving section 200 that performs processing of generating a driving signal of the control valve 20 according to the corrected velocity signal generated by the information processing section 100, as depicted in FIG. 2. Details of the information processing section 100 will next be described.

—Information Processing Section 100—

The information processing section 100 receives operation signals from the right operation lever 1*c* and the left operation lever 1*d*, receives posture data (first posture data) of the boom 11, posture data (second posture data) of the arm 12, posture data (third posture data) of the bucket 8, and machine body posture data from the first posture sensor 13*a*, the second posture sensor 13*b*, the third posture sensor 13*c*, and the machine body posture sensor 13*d*, respectively, receives positional data of on the target surface 60 in the machine body coordinate system from the target surface setting device 18, calculates actuator velocity signals, and transmits the actuator velocity signals to the control valve driving section 200. The control valve driving section 200 drives the control valve 20 by generating and outputting control valve driving signals according to the actuator velocity signals calculated by the information processing section 100.

Figure 3:
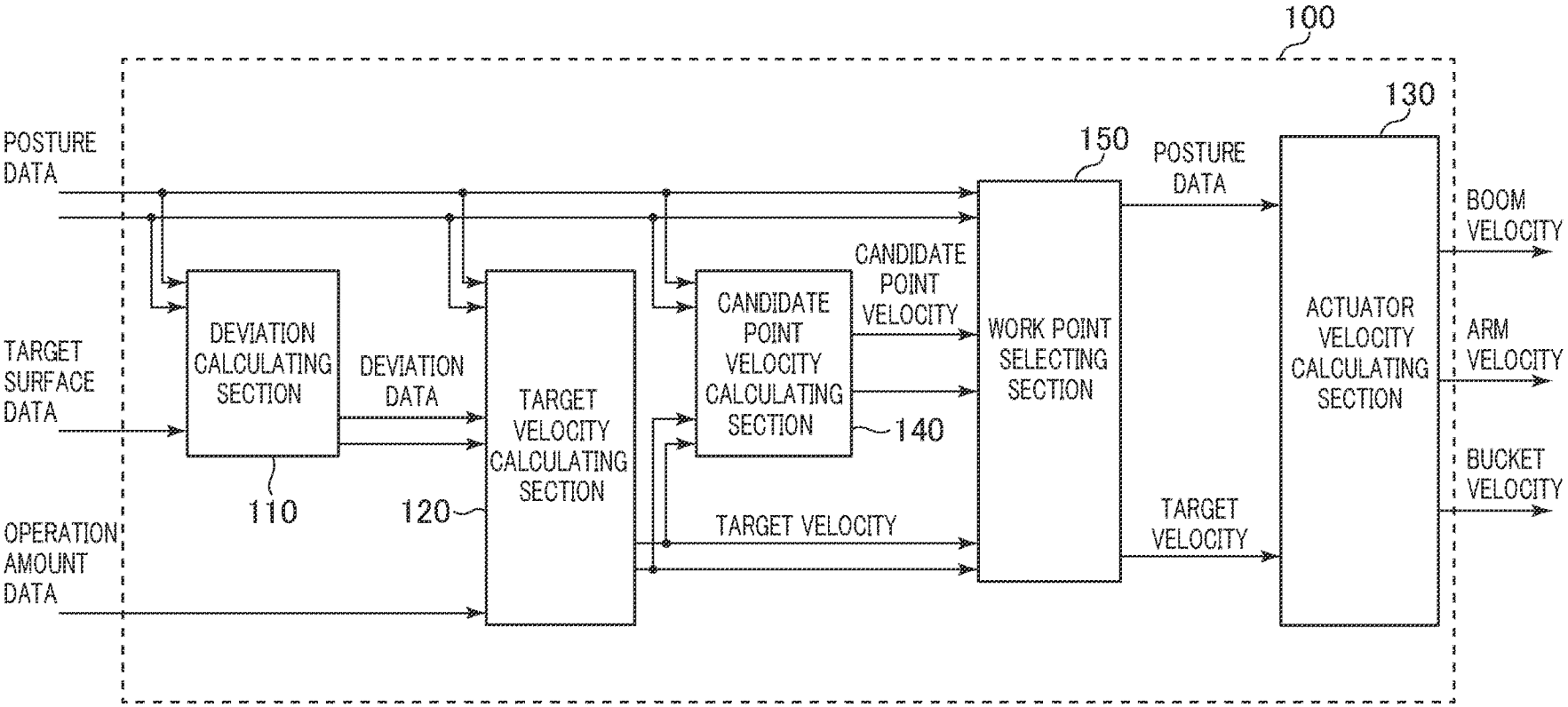
FIG. 3 is a block diagram depicting a detailed configuration of an information processing device depicted in FIG. 2.

Details of the information processing section 100 will be described with reference to FIG. 3. As depicted in FIG. 3, the information processing section 100 includes a deviation calculating section 110, a target velocity calculating section 120, an actuator velocity calculating section 130, a candidate point velocity calculating section 140, and a work point selecting section 150. The information processing section 100 outputs the output of the actuator velocity calculating section 130 as actuator velocities to the control valve driving section 200. Each section will be described in the following.

The deviation calculating section 110 is a part that calculates a distance deviation between each of the two work point candidates 8*a* and 8*b* and the target surface 60 (that is, shortest distances from the work point candidates 8*a* and 8*b* to the target surface 60 (which distances will be referred to also as target surface distances)) on the basis of the posture data of the work device 15 and the positional data of the target surface 60. First, the deviation calculating section 110 calculates the position of the bucket tip end 8*a* and the position of the bucket back surface end 8*b* from the posture data from the posture sensors 13*a* to 13*d* (including dimension information of each of the front implement members 11, 12, and 8). Next, the deviation calculating section 110 calculates a distance Da between the bucket tip end 8*a* and the target surface and a distance Db between the bucket back surface end 8*b* and the target surface from the calculated positional data of the bucket tip end 8*a* and the bucket back surface end 8*b* and the positional data of the target surface (target surface data), the positional data of the target surface being input from the target surface setting device 18, and outputs the distance Da and the distance Db as distance deviation data (distance deviations Da and Db) of the bucket tip end 8*a* and the back surface end 8*b* to the target velocity calculating section 120. Incidentally, with regard to the processing of extracting the target surface 60, a line of intersection of a plane passing through the bucket tip end 8*a* (bucket back surface end 8*b*) and parallel with an operation plane of the work device 15 (for example, a plane orthogonal to the rotational axis of the boom 11) and three-dimensional design data can be set as the target surface 60 (the same is true for a second embodiment).

The target velocity calculating section 120 calculates each of the velocities of the bucket tip end 8*a* and the back surface end 8*b* which velocities are necessary to move the bucket tip end 8*a* and the back surface end 8*b* along the target surface 60 according to the distance deviation data of the bucket tip end 8*a* and the back surface end 8*b* which distance deviation data is input from the deviation calculating section 110, and outputs the velocities as target velocities VTa and VTb of the bucket tip end 8*a* and the back surface end 8*b*.

Figure 19:
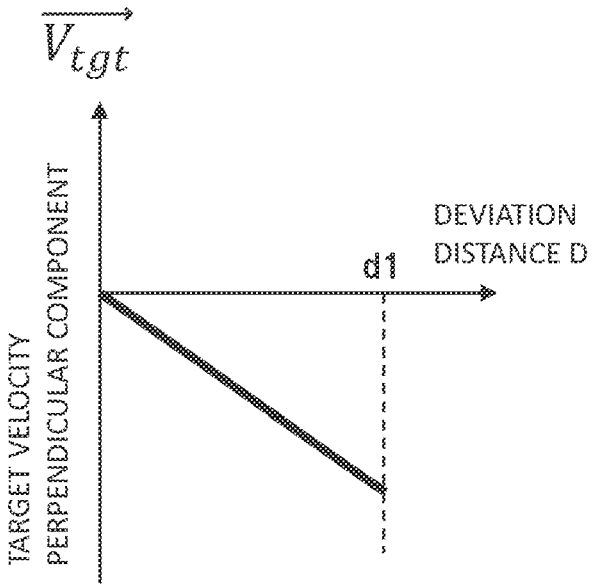
FIG. 19 is a diagram defining relation between a deviation distance D between a target surface and a work point candidate and a target value Vtgt of a component of a velocity vector of the work point candidate which component is perpendicular to the target surface.
Figure 20:
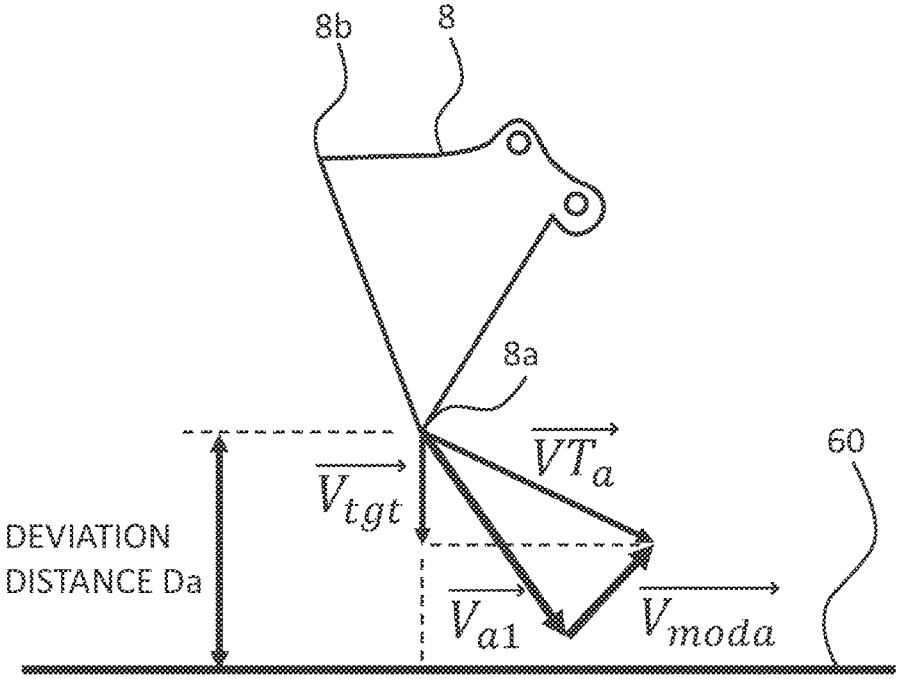
FIG. 20 is an explanatory diagram in a case where the trajectory of a bucket tip end which trajectory results from an arm operation is corrected by a boom operation.

An example of the calculation of the target velocities in the target velocity calculating section 120 will be described in the following with reference to FIG. 19 and FIG. 20. In order to simplify the description in the present embodiment, the description will be made by citing as an example a case where the operator is assumed to only operate the arm 12 (arm cylinder 6) by the operation lever 1*d* in excavation work of the work device 15 (that is, the operator is assumed to operate neither the boom 11 nor the bucket 8), and that a work point (the bucket tip end 8*a* or the bucket back surface end 8*b*) is moved along the target surface 60 by correcting, by only operation of the boom 11, a velocity vector (Va1 or Vb1) occurring at the work point due to the arm operation. In this case, a velocity vector generated at the bucket tip end 8*a* or the bucket back surface end 8*b* by the boom operation correcting the arm operation by the operator is set as Vmoda or Vmodb (see FIG. 20), and the velocity vector of the bucket tip end 8*a* or the bucket back surface end 8*b* after the correction by Vmoda or Vmodb is the target velocity VTa or VTb.

First, the target velocity calculating section 120 calculates a target value (target velocity perpendicular component) Vtgt of a component of the velocity vector of the bucket tip end 8*a* or the back surface end 8*b* which component is perpendicular to the target surface 60 (which component will hereinafter be abbreviated to a "perpendicular component") on the basis of the distance deviation D calculated by the deviation calculating section 110 and a table of FIG. 19 (Vtgt generally assumes different values for the bucket tip end 8*a* and the bucket back surface end 8*b*). When the perpendicular component of the velocity vector Va1 or Vb1 generated at the work point candidate 8*a* or 8*b* by the arm operation input by the operator is different from the target value Vtgt, the controller 500 corrects the velocity vector Va1 or Vb1 by generating the velocity vector (Vmoda or Vmodb) by the boom operation based on semiautomatic excavation and shaping control (referred to also as machine control or region limiting control) such that the perpendicular component of the velocity vector generated at the work point candidate 8*a* or 8*b* (that is, the target velocity VTa or VTb) is Vtgt. The target velocity calculating section 120 outputs the velocity vector after this correction as the target velocity VTa or VTb. As depicted in FIG. 19, the target velocity perpendicular component Vtgt is zero when the distance deviation D is zero, and is set so as to monotonically decrease according to increase in the distance deviation D. The target value Vtgt is not set (that is, the velocity vector of an any perpendicular component can be output) in a range in which the distance deviation D exceeds a predetermined value d1. A method of determining the target velocity perpendicular component Vtgt is not limited to the table of FIG. 19, but is replaceable as long as the target velocity perpendicular component Vtgt monotonically decreases in at least a range of the distance deviation D from zero to a predetermined positive value (for example, d1).

—Candidate Point Velocity Calculating Section 140—

The candidate point velocity calculating section 140 is a part that calculates a velocity occurring at a remaining work point candidate (which may hereinafter be referred to as a "candidate point velocity") when each of the plurality of work point candidates 8*a* and 8*b* is moved at the corresponding target velocity among the plurality of target velocities calculated by the target velocity calculating section 120. For example, the candidate point velocity calculating section 140 calculates, as the candidate point velocity, a velocity occurring at the remaining work point candidate 8*b* when the work point candidate 8*a* is moved at the target velocity VTa of the work point candidate 8*a*. In the following, the velocity occurring at the work point candidate 8*b* when the work point candidate 8*a* is moved at the target velocity VTa will be referred to as a candidate point velocity VTab, and a velocity occurring at the work point candidate 8*a* when the work point candidate 8*b* is moved at the target velocity VTb will be referred to as a candidate point velocity VTba.

Figure 5:
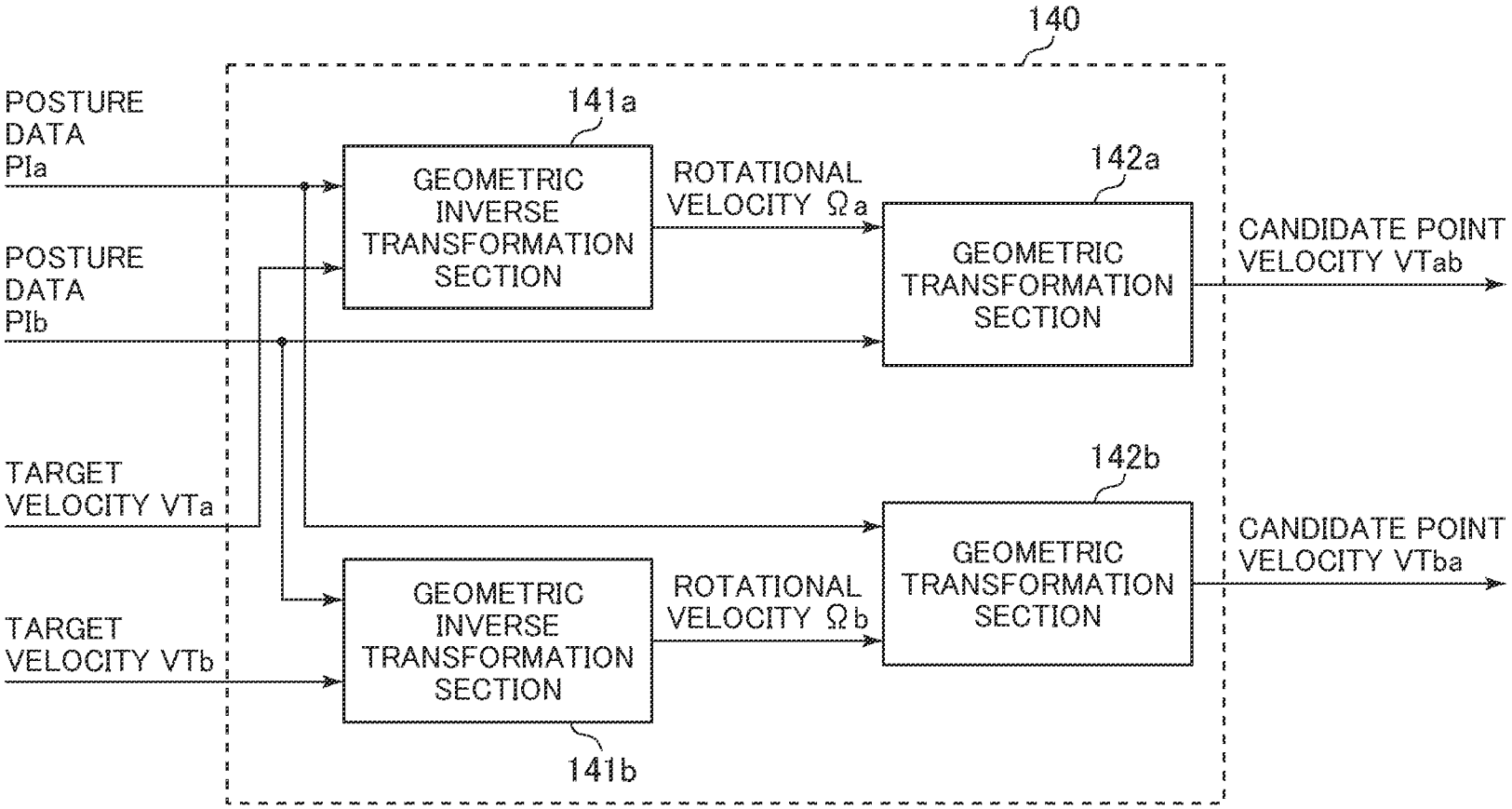
FIG. 5 is a block diagram depicting a detailed configuration of a candidate point velocity calculating section depicted in FIG. 3.

The candidate point velocity calculating section 140 will be described in detail with reference to FIG. 5. The candidate point velocity calculating section 140 includes geometric inverse transformation sections 141*a* and 141*b* and geometric transformation sections 142*a* and 142*b*.

The geometric inverse transformation section 141*a* calculates a combination Ωa of the rotational velocities (angular velocities) of the boom 11 and the arm 12 when the bucket tip end 8*a* operates at the target velocity VTa from posture data PIa of the bucket tip end 8*a* and the target velocity VTa of the bucket tip end 8*a*. The geometric inverse transformation section 141*a* then outputs the combination Ωa to the geometric transformation section 142*a*. With regard to the calculation of the combination Ωa of the rotational velocities, a velocity vector generated at the bucket tip end 8*a* by the boom operation when the bucket tip end 8*a* operates at the target velocity VTa is Vmoda (see FIG. 20) described above. Thus, the rotational velocity ωmod1 of the boom 11 can be calculated from the velocity Vmoda and the posture data PIa. On the other hand, a velocity vector generated at the bucket tip end 8*a* by the arm operation by the operator is Va1. Thus, the rotational velocity ωa1 of the arm 12 can be calculated from the velocity Va1 and the posture data PIa.

The geometric inverse transformation section 141*b* calculates a combination Ωb of the rotational velocities of the boom 11 and the arm 12 when the bucket back surface end 8*b* operates at the target velocity VTb from posture data PIb of the bucket back surface end 8*b* and the target velocity VTb of the bucket back surface end 8*b*. The geometric inverse transformation section 141*b* then outputs the combination Ωb to the geometric transformation section 142*b*. The calculation of the combination Ωb of the rotational velocities can be performed similarly to the contents performed by the geometric inverse transformation section 141*a*.

The geometric transformation section 142*a* calculates the candidate point velocity VTab (second candidate point velocity) as a velocity occurring at the bucket back surface end 8*b* (second work point candidate) when the bucket tip end 8*a* (first work point candidate) operates at the target velocity VTa (that is, when the boom 11 is operated at the rotational velocity ωmod1 and the arm 12 is operated at the rotational velocity ωa1) from the combination Ωa of the rotational velocities and the posture data PIb of the bucket back surface end 8*b*.

The geometric transformation section 142*b* calculates the candidate point velocity VTba (first candidate point velocity) as a velocity of the bucket tip end 8*a* (first work point candidate) when the bucket back surface end 8*b* (second work point candidate) operates at the target velocity VTb from the combination Ωb of the rotational velocities and the posture data PIa of the bucket tip end 8*a*.

Incidentally, instead of calculating the combinations Ωa and Ωb of the rotational velocities of the boom 11 and the arm 12 in the geometric inverse transformation sections 141*a* and 141*b*, the geometric inverse transformation sections 141*a* and 141*b* may be configured to calculate combinations of operation velocities of the boom cylinder 5 and the arm cylinder 6, and use the combinations as output to the geometric transformation sections 142*a* and 142*b*.

Figure 8:
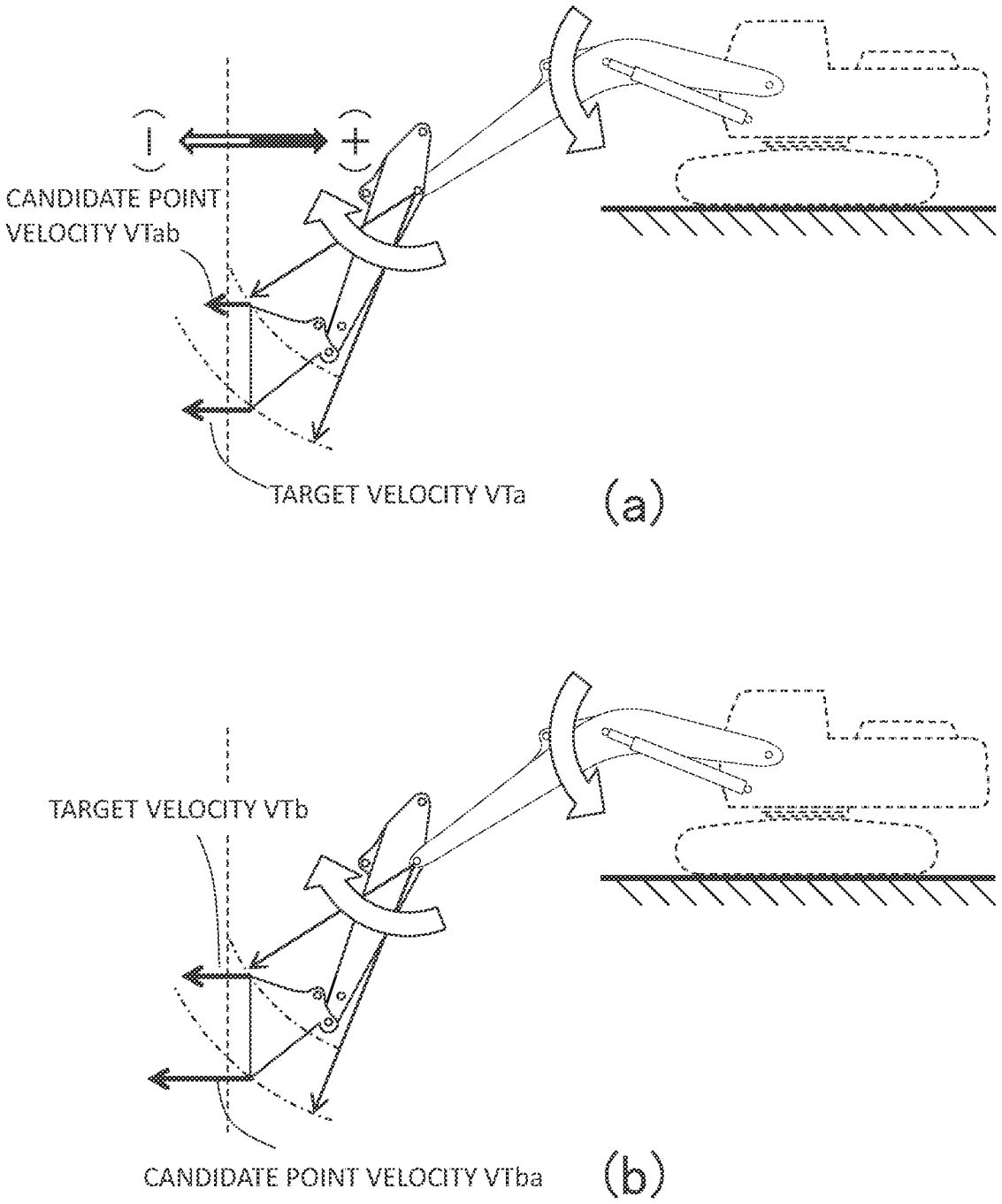
FIG. 8 is a diagram depicting velocity vectors at a time of vertical surface excavation in the first embodiment of the present invention.

FIG. 8 depicts relations between the target velocity VTa and the candidate point velocity VTab and between the target velocity VTb and the candidate point velocity VTba (however, only perpendicular components of the respective velocities with respect to the target surface 60 are extracted and depicted). In this case, the bucket tip end 8*a* and the bucket back surface end 8*b* are assumed to be equidistant from the target surface. Thus, the target velocity VTa and the target velocity VTb are a same value. When the bucket tip end 8*a* operates at the target velocity VTa, the bucket back surface end 8*b* operates at the candidate point velocity VTab. The rotation radius of the bucket back surface end 8*b* is smaller than the rotation radius of the bucket tip end 8*a*. The absolute value of the candidate point velocity VTab is therefore smaller than that of the target velocity VTa. When the bucket back surface end 8*b* operates at the target velocity VTb, the bucket tip end 8*a* operates at the candidate point velocity VTba. The rotation radius of the bucket tip end 8*a* is larger than the rotation radius of the bucket back surface end 8*b*. The absolute value of the candidate point velocity VTba is therefore larger than that of the target velocity VTb. When the magnitudes of the target velocities and the candidate point velocities are compared with each other with attention given to signs, Candidate Point Velocity VTab>Target Velocity VTa=Target Velocity VTb>Candidate Point Velocity VTba. The target velocities are derived such that the work points assuming the target velocities do not enter the target surface. It is therefore understood that the bucket back surface end 8*b* assuming the candidate point velocity VTab does not enter the target surface, and that there is a possibility that the bucket tip end 8*a* assuming the candidate point velocity VTba enters the target surface.

—Work Point Selecting Section 150—

The work point selecting section 150 is a part that performs processing of selecting a candidate point velocity that makes all of the two work point candidates 8*a* and 8*b* least likely to perform an operation of entering the target surface 60 from the two candidate point velocities VTab and VTba, and selecting the work point candidate associated with the selected candidate point velocity as a work point (control point) of semiautomatic excavation and shaping control. The work point selecting section 150 in the present embodiment selects the larger of the two candidate point velocities VTab and VTba, and sets the work point candidate associated with the selected candidate point velocity as the work point.

Figures 6, 7:
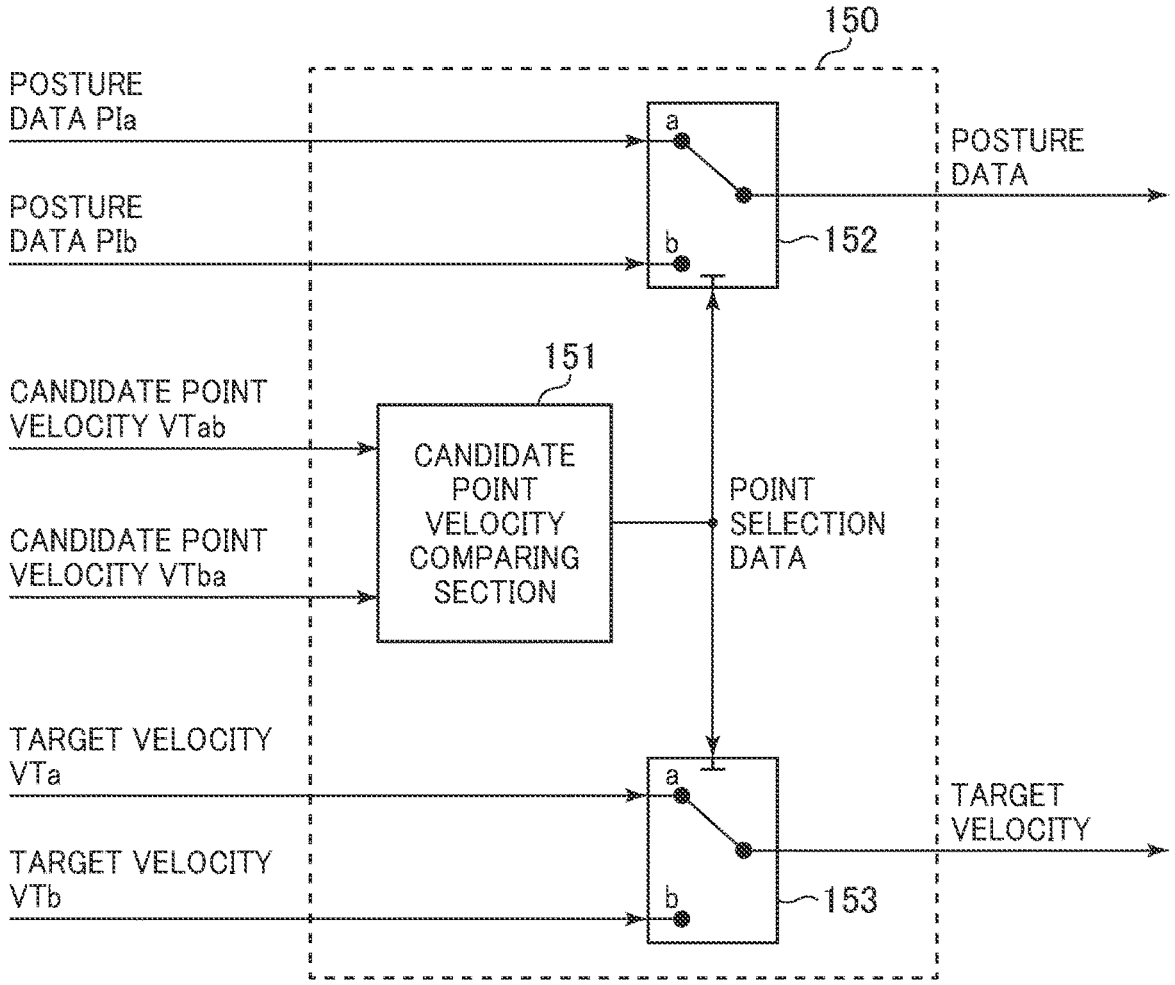
FIG. 6 is a block diagram depicting a detailed configuration of a work point selecting section depicted in FIG. 3.
FIG. 7 is a truth table depicting relation between input values of a candidate point velocity comparing section in the first embodiment of the present invention and resulting output.

The work point selecting section 150 will be described with reference to FIG. 6. The work point selecting section 150 includes a candidate point velocity comparing section 151, a posture data switching section 152, and a target velocity switching section 153. The candidate point velocity comparing section 151 compares the candidate point velocity VTab and the candidate point velocity VTba input from the candidate point velocity calculating section 140 with each other, and selects the bucket tip end 8*a* as the work point when Candidate Point Velocity VTab>Candidate Point Velocity VTba (that is, when the candidate point velocity VTab (second candidate point velocity) is a velocity that makes an entry into the target surface less likely than the candidate point velocity VTba (first candidate point velocity). When Candidate Point Velocity VTab<Candidate Point Velocity VTba (that is, when the candidate point velocity VTba (first candidate point velocity) is a velocity that makes an entry into the target surface less likely than the candidate point velocity VTab (second candidate point velocity), on the other hand, the candidate point velocity comparing section 151 selects the bucket back surface end 8*b* as the work point. Then, the work point selecting section 150 outputs point selection data indicating which of the two work point candidates 8*a* and 8*b* is selected. When the bucket tip end 8*a* is selected as the work point, the work point selecting section 150 outputs point selection data a for switching two 2-position switches (the posture data switching section 152 and the target velocity switching section 153) depicted in FIG. 6 to a position a. When the bucket back surface end 8*b* is selected as the work point, the work point selecting section 150 outputs point selection data b for switching the same 2-position switches to a position b. FIG. 7 is a summary of these relations in a truth table.

The posture data switching section 152 outputs the posture data PIa associated with the bucket tip end 8*a* as posture data when the work point indicated by the point selection data is the bucket tip end 8*a*. The posture data switching section 152 outputs the posture data PIb associated with the bucket back surface end 8*b* as posture data when the work point is the bucket back surface end 8*b*.

The target velocity switching section 153 outputs the target velocity VTa associated with the bucket tip end 8*a* as target velocity when the work point indicated by the point selection data is the bucket tip end 8*a*. The target velocity switching section 153 outputs the target velocity VTb associated with the bucket back surface end 8*b* as target velocity when the work point is the bucket back surface end 8*b*.

The actuator velocity calculating section 130 geometrically calculates the target velocities of the boom cylinder 5, the arm cylinder 6, and the bucket cylinder 7 which target velocities are necessary to operate the work point at the target velocity using the posture data and the target velocity output from the work point selecting section 150. The actuator velocity calculating section 130 then outputs the target velocities to the control valve driving section 200.

The control valve driving section 200 generates driving signals (control valve driving signals) to the control valve 20 which driving signals correspond to the respective hydraulic cylinders 5, 6, and 7, in order to achieve the target velocities of the hydraulic cylinders 5, 6, and 7 which target velocities are input from the information processing section 100. The control valve driving section 200 then outputs the driving signals to the control valve 20. By controlling the hydraulic cylinders 5, 6, and 7 according to the driving signals, it is possible to operate the work point (one of the bucket tip end 8*a* and the bucket back surface end 8*b*) selected by the work point selecting section 150 at the target velocity (VTa or VTb), and prevent an entry of both of the two work point candidates 8*a* and 8*b* into the target surface 60.

—Processing Flow of Controller 500—

Figure 9:
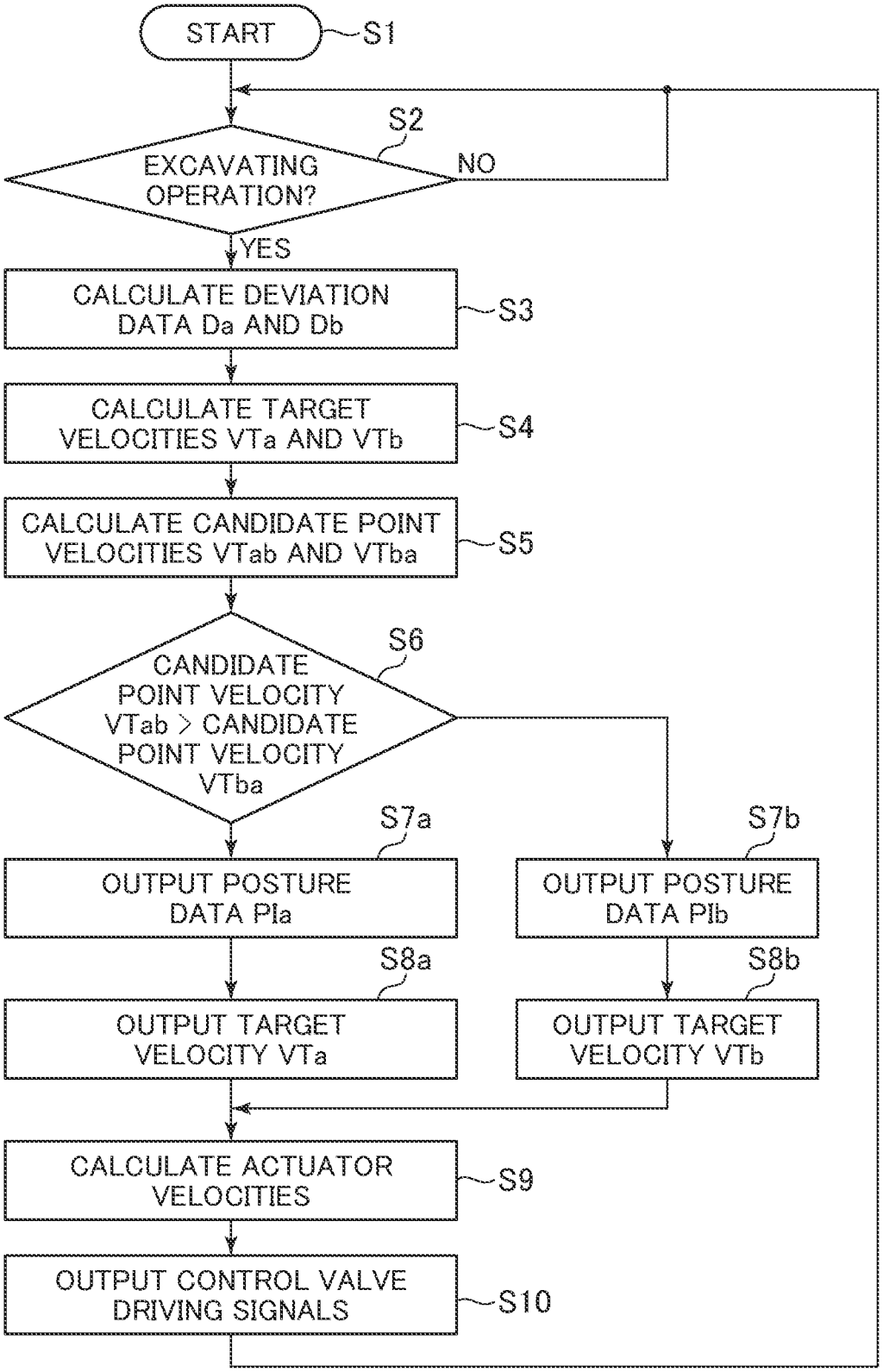
FIG. 9 is a flowchart depicting a flow of control in the first embodiment of the present invention.
Figure 10:
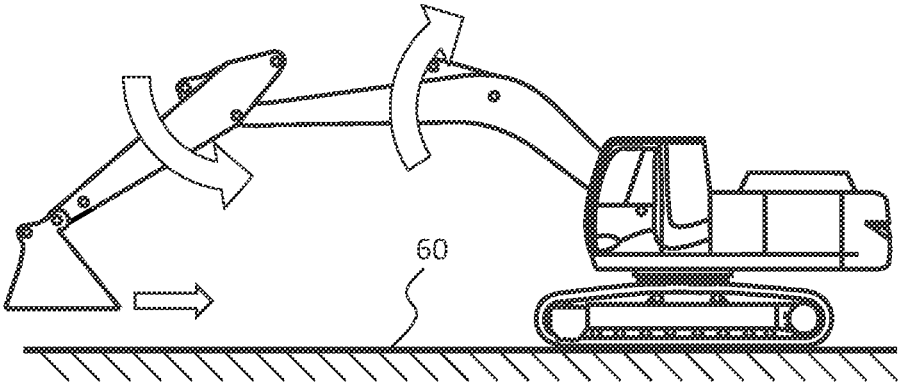
FIG. 10 is a diagram depicting an example of operation at a time of horizontal surface excavation of the work machine.
Figure 11:
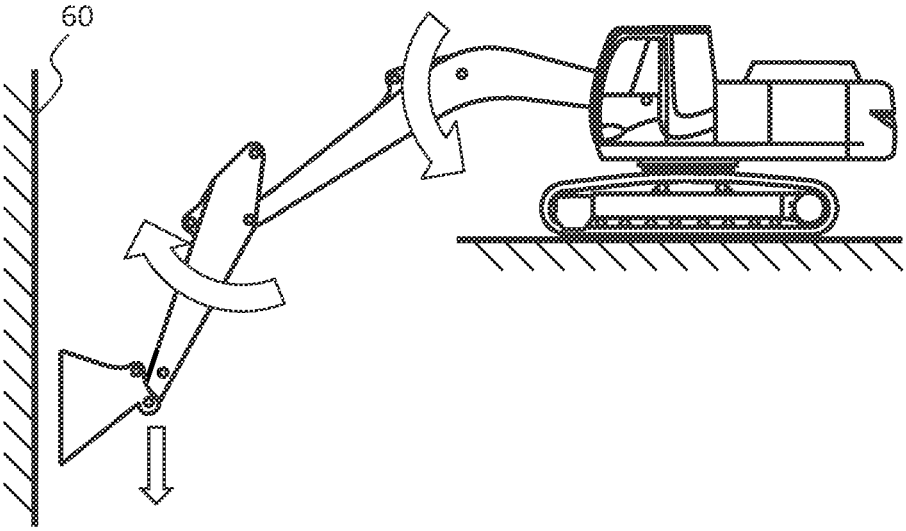
FIG. 11 is a diagram depicting an example of operation at a time of vertical surface excavation of the work machine.
Figure 12:
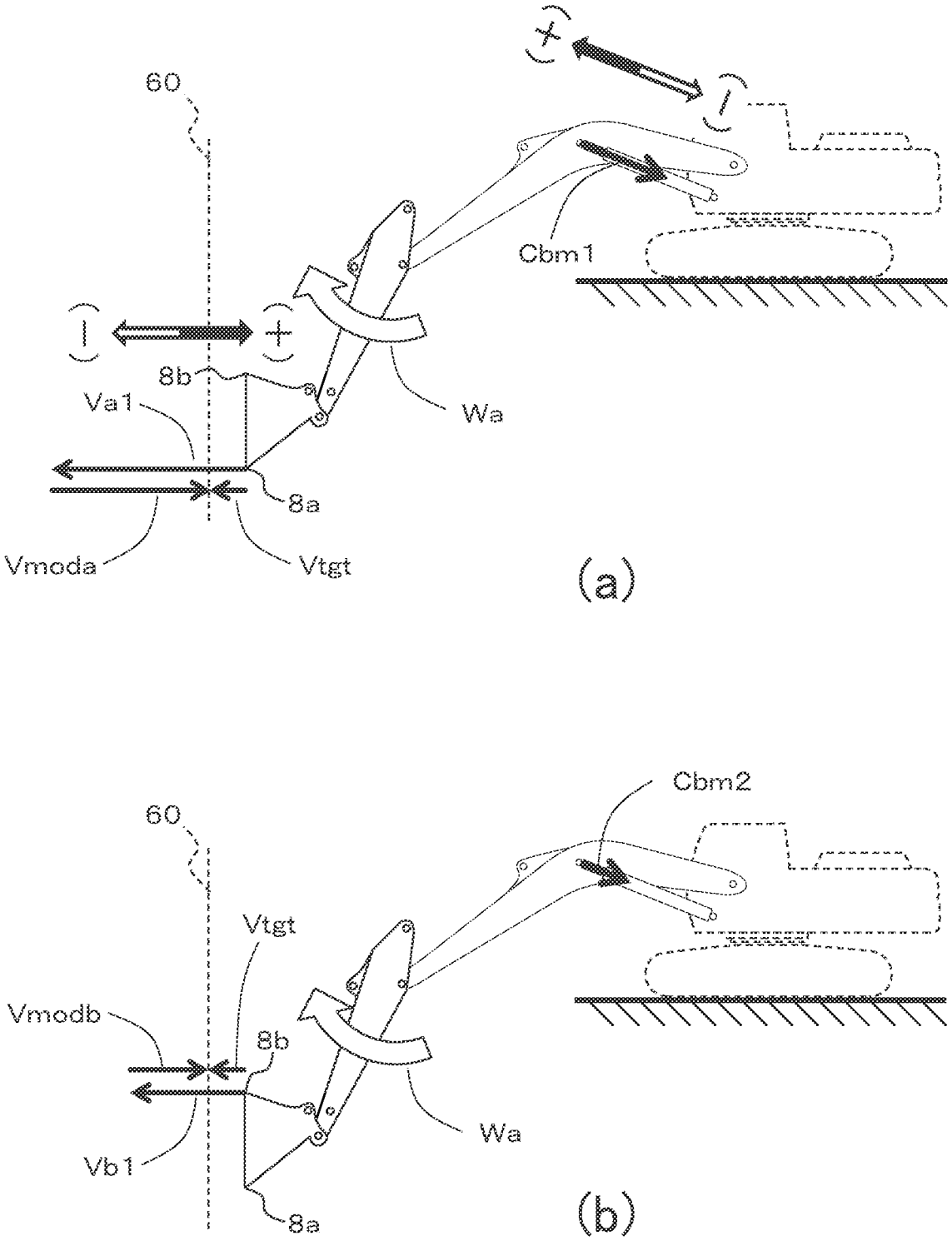
FIG. 12 is a diagram depicting velocity vectors at the time of the vertical surface excavation of the work machine.

FIG. 9 is a flowchart depicting a flow of calculation by the above-described controller 500. The controller 500 starts processing in a predetermined control cycle (step S1). The controller 500 determines whether or not the operation levers 1*c* and 1*d* are operated on the basis of input operation signals (step S2). Here, the processing proceeds to step S3 when the operation levers 1*c* and 1*d* are operated. The processing otherwise waits until the operation levers 1*c* and 1*d* are operated.

In step S3, the deviation calculating section 110 calculates deviation data Da and Db between the bucket tip end 8*a* and the bucket back surface end 8*b* and the target surface 60 from the posture data PIa and PIb obtained from the posture sensors 13*a*, 13*b*, 13*c*, and 13*d* and the target surface data obtained from the target surface setting device 18.

In step S4, the target velocity calculating section 120 calculates the target velocities VTa and VTb from the deviation data Da and Db, the posture data PIa and PIb, and operation amount data obtained from the operation levers 1*c* and 1*d*.

In step S5, the candidate point velocity calculating section 140 calculates the candidate point velocities VTba and VTab, which are each the velocity of another work point candidate when one work point candidate 8*a* or 8*b* is operated at the target velocity VTa or VTb, from the target velocities VTa and VTb and the posture data PIa and PIb.

In step S6, the work point selecting section 150 compares the magnitudes of the two candidate point velocities VTab and VTba calculated in step S5 with each other, and selects, as the work point, the work point candidate corresponding to the candidate point velocity having a larger value. The processing proceeds to step S7*a* when the bucket tip end 8*a* is selected as the work point. The processing proceeds to step S7*b* when the bucket back surface end 8*b* is selected as the work point.

In step S7*a*, the work point selecting section 150 outputs the posture data PIa related to the work point 8*a* to the actuator velocity calculating section 130. In the following step S8*a*, the work point selecting section 150 outputs the target velocity VTa related to the work point 8*a* to the actuator velocity calculating section 130. The processing then proceeds to step S9.

In step S7*b*, the work point selecting section 150 outputs the posture data PIb related to the work point 8*b* to the actuator velocity calculating section 130. In the following step S8*b*, the work point selecting section 150 outputs the target velocity VTb related to the work point 8*b* to the actuator velocity calculating section 130. The processing then proceeds to step S9.

In step S9, the actuator velocity calculating section 130 receives, as input thereto, the posture data PIa or PIb and the target velocity VTa or VTb output by the work point selecting section 150, and calculates command values of a boom cylinder velocity, an arm cylinder velocity, and a bucket cylinder velocity. The actuator velocity calculating section 130 outputs the command values to the control valve driving section 200. The processing then proceeds to step S10.

In step S10, the control valve driving section 200 generates the control valve driving signals corresponding to the boom cylinder velocity, the arm cylinder velocity, and the bucket cylinder velocity calculated in step S9, and outputs the control valve driving signals to the control valve 20 that controls the hydraulic cylinders 5, 6, and 7. The driving signals drive the control valve 20 to operate the respective hydraulic cylinders 5, 6, and 7. The work device 15 operates on the basis of the operation of the hydraulic cylinders 5, 6, and 7. It is thereby possible to prevent both of the two work point candidates 8*a* and 8*b* from entering the target surface 60.

—Action and Effect—

In the hydraulic excavator according to the present embodiment configured as described above, the target velocities VTa and VTb are respectively calculated for the two work point candidates 8*a* and 8*b* set to the work device 15 on the basis of the deviation data Da and Db with respect to the target surface 60, and also calculates the velocities (candidate point velocities) VTab and VTba occurring at the other work point candidates when each of the work point candidates 8*a* and 8*b* is moved at the target velocity VTa or VTb. The entry of the work point candidate not selected as the work point among the two work point candidates 8*a* and 8*b* into the target surface 60 becomes a problem in cases where there is a difference between distances of the two work point candidates 8*a* and 8*b* from the center of rotation of the arm 12 (rotation radii of the respective work point candidates 8*a* and 8*b*). When one work point candidate is operated at the target velocity, and the velocity (candidate point velocity) of the other work point candidate is larger than the target velocity, the velocity (candidate point velocity) of the one work point candidate when the other work point candidate is operated at the target velocity is smaller than the target velocity. Accordingly, the work point candidate associated with the candidate point velocity at which an entry into the target surface 60 is possibly made later among the two candidate point velocities VTab and VTba (that is, the candidate point velocity of the larger magnitude of the two candidate point velocities) is selected as the work point. When the work point is thus selected, the remaining work point candidate not selected as the work point among the two work point candidates 8*a* and 8*b* can also be prevented from entering the target surface 60. Thus, also for a target surface located at a position from which the work point candidates 8*a* and 8*b* are separated by boom lowering, the plurality of work point candidates 8*a* and 8*b* on the work device 15 can be prevented from entering the target surface 60. It is thereby possible to improve accuracy and efficiency of work by the hydraulic excavator.

It is to be noted that the work point selecting process described above is an example, and that another method may be used, which, for example, compares the perpendicular components of the target velocities VTa and VTb of the two work point candidates 8*a* and 8*b* with each other and selects a relatively smaller target velocity, and when there is a smaller candidate point velocity than the selected target velocity, selects the work point candidate different from the work point candidate associated with the smaller candidate point velocity as the work point.

Second Embodiment

Figure 13:
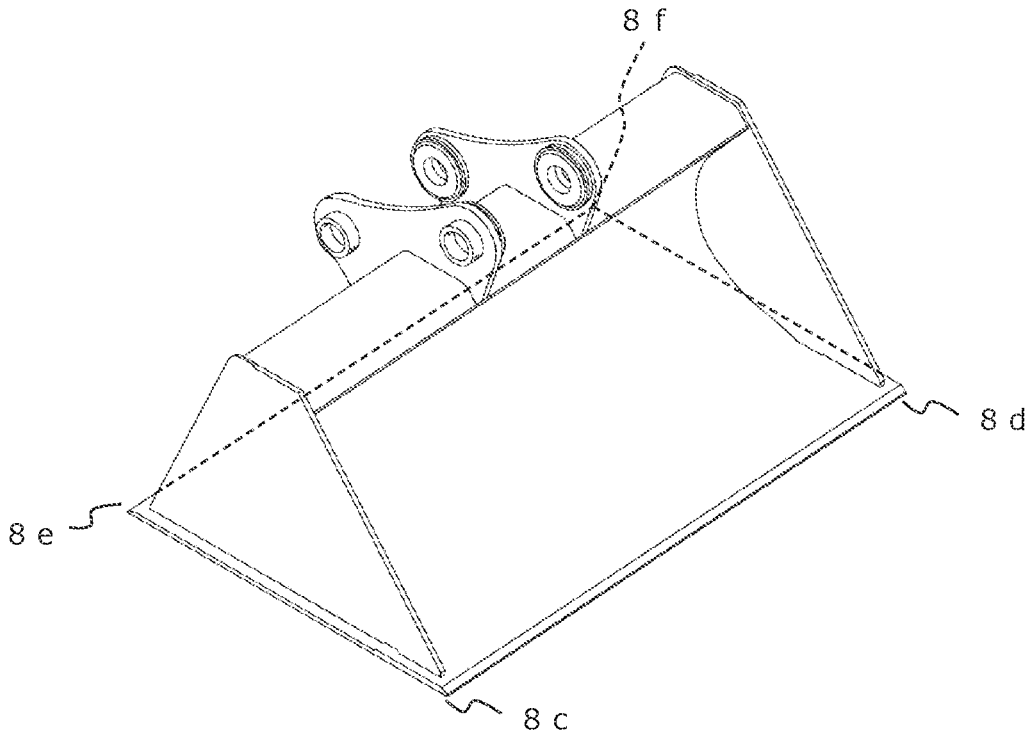
FIG. 13 is a diagram depicting the setting of work point candidates in a second embodiment of the present invention.

A second embodiment of the present invention will be described in the following. The present embodiment sets work point candidates of the bucket 8 at four points of a bucket left tip end 8*c*, a bucket right tip end 8*d*, a bucket left back surface end 8*e*, and a bucket right back surface end 8*f* as depicted in FIG. 13. The present embodiment is effective in preventing an entry of the bucket 8 into the target surface 60 in, for example, a case where a tilting bucket is used as the bucket 8, a case where the target surface 60 is not parallel with the rotational axis of the boom, or the like. Incidentally, the hydraulic excavator 1 has the same hardware configuration as in the first embodiment. The following description will be made mainly of a configuration (software configuration) of the information processing section 100 within the controller 500. However, description of parts common with the first embodiment in relation to the configuration of the controller 500 and calculation processing may be omitted as appropriate.

The controller 500 according to the present embodiment includes an information processing section 100 and a control valve driving section 200 as in the first embodiment. The information processing section 100 includes a deviation calculating section 110, a target velocity calculating section 120, a candidate point velocity calculating section 140, a work point selecting section 150, and an actuator velocity calculating section 130.

The deviation calculating section 110 calculates a distance Dc between the bucket left tip end 8*c* and the target surface 60, a distance Dd between the bucket right tip end 8*d* and the target surface 60, a distance De between the bucket left back surface end 8*e* and the target surface 60, and a distance Df between the bucket right back surface end 8*f* and the target surface 60 from the positions of the bucket left tip end 8*c* position, the bucket right tip end 8*d*, the bucket left back surface end 8*e*, and the bucket right back surface end 8*f*, the positions being calculated from the posture data from the posture sensors 13*a* to 13*d*, and the target surface data input from the target surface setting device 18. The deviation calculating section 110 outputs these distances as distance deviation data of the left and right tip ends and the left and right back surface ends of the bucket.

The target velocity calculating section 120 calculates the velocities of the left and right tip ends 8*c* and 8*d* and the left and right back surface ends 8*e* and 8*d* of the bucket which velocities are necessary to move the left and right tip ends 8*c* and 8*d* and the left and right back surface ends 8*e* and 8*d* of the bucket along the target surface 60 on the basis of the distance deviation data of the left and right tip ends 8*c* and 8*d* and the left and right back surface ends 8*e* and 8*d* of the bucket. The target velocity calculating section 120 outputs the velocities as target velocities (VTc, VTd, VTe, and VTf) of the left and right tip ends 8*c* and 8*d* and the left and right back surface ends 8*e* and 8*d* of the bucket.

—Candidate Point Velocity Calculating Section 140—

Figure 16:
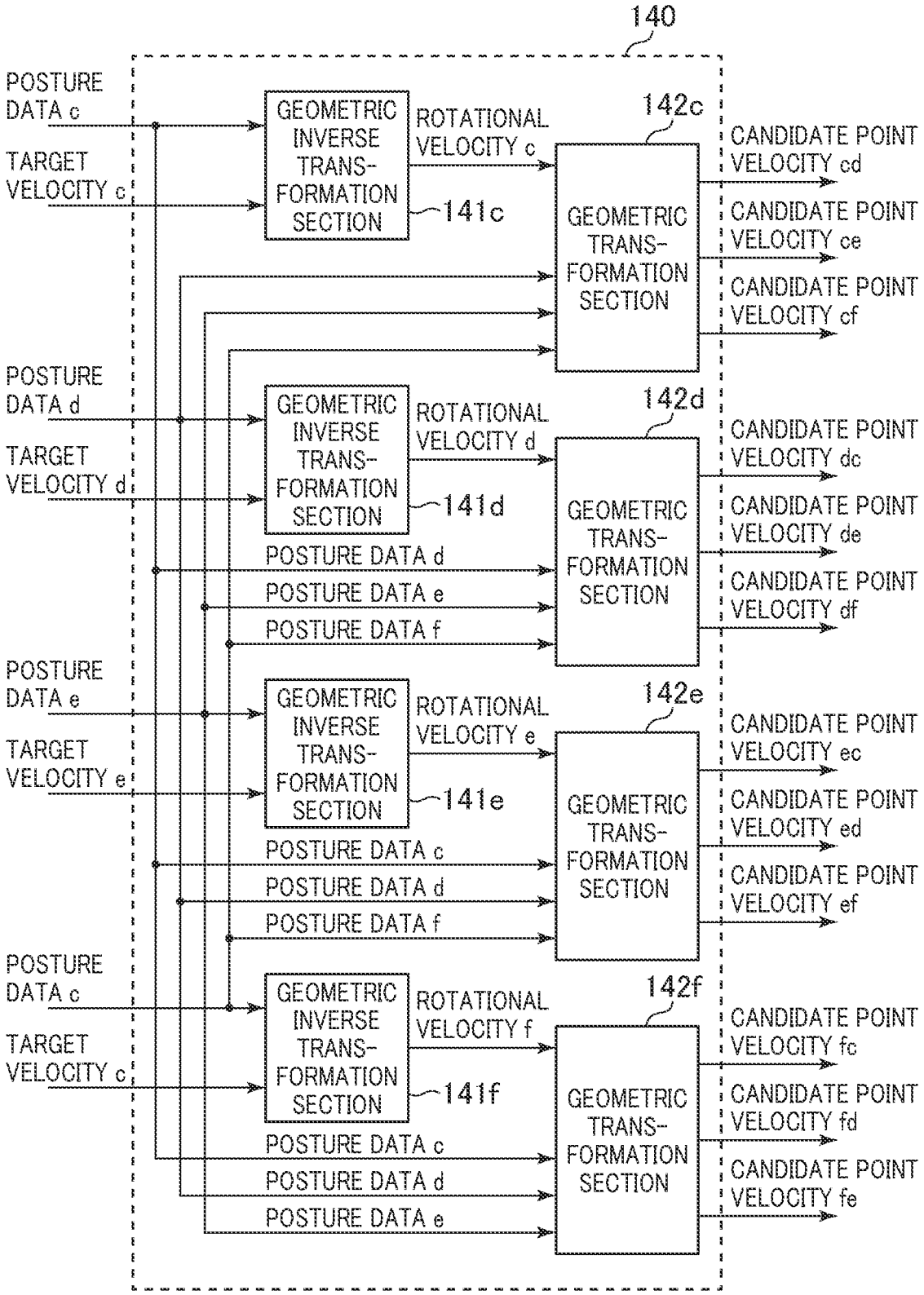
FIG. 16 is a block diagram depicting a detailed configuration of a candidate point velocity calculating section in the second embodiment of the present invention.

FIG. 16 is a diagram depicting the candidate point velocity calculating section 140 in the second embodiment. As in the first embodiment, the candidate point velocity calculating section 140 includes geometric inverse transformation sections 141*c*, 141*d*, 141*e*, and 141*f* and geometric transformation sections 142*c*, 142*d*, 142*e*, and 142*f*.

The geometric inverse transformation sections 141*c*, 141*d*, 141*e*, and 141*f* calculate combinations Ωc, Ωd, Ωe, and Ωf of the rotational velocities (angular velocities) of the boom 11 and the arm 12 when the left and right tip ends 8*c* and 8*d* and the left and right back surface ends 8*e* and 8*d* of the bucket operate at the respective target velocities (VTc, VTd, VTe, and VTf) of the left and right tip ends 8*c* and 8*d* and the left and right back surface ends 8*e* and 8*d* from the posture data of the left and right tip ends 8*c* and 8*d* and the left and right back surface ends 8*e* and 8*d* of the bucket and the target velocities (VTc, VTd, VTe, and VTf) of the left and right tip ends 8*c* and 8*d* and the left and right back surface ends 8*e* and 8*d* of the bucket. The geometric transformation sections 142*c*, 142*d*, 142*e*, and 142*f* calculate candidate point velocities VTcd, VTce, VTcf, VTdc, VTde, VTdf, VTec, VTed, VTef, VTfc, VTfd, and VTfe as the velocities of remaining work point candidates from the combinations Ωc, Ωd, Ωe, and Ωf of the rotational velocities and the posture data of the left and right tip ends 8*c* and 8*d* and the left and right back surface ends 8*e* and 8*d* of the bucket.

The candidate point velocities VTcd, VTce, and VTcf are velocities occurring at three remaining work point candidates (the bucket right tip end 8*d*, the bucket left back surface end 8*e*, and the bucket right back surface end 8*f*) when the bucket left tip end 8*c* is operated at the target velocity VTc. In the following, the velocities occurring at the three work point candidates will be set as one group (velocity group), and will be referred to as a candidate point velocity c-group as a set of the candidate point velocities related to the work point candidate 8*c* operated at the target velocity VTc. In addition, the candidate point velocities VTdc, VTde, and VTdf are the velocities of three remaining work point candidates when the bucket right tip end 8*d* is operated at the target velocity VTd, and will hereinafter be referred to as a candidate point velocity d-group. Similarly, the candidate point velocities VTec, VTed, and VTef will be referred to as a candidate point velocity e-group, and the candidate point velocities VTfc, VTfd, and VTfe will be referred to as a candidate point velocity f-group. That is, the candidate point velocity calculating section 140 calculates the velocities occurring at the three remaining work point candidates when each of the four work point candidates 8*c*, 8*d*, 8*e*, and 8*f* is moved at the corresponding target velocity among the four target velocities VTc, VTd, VTe, and VTf calculated by the target velocity calculating section 120, and creates the four velocity groups (candidate point velocity c-group to f-group) by grouping the velocities occurring at the three remaining work point candidates for each work point candidate.

Incidentally, the output of the geometric inverse transformation sections 141*c*, 141*d*, 141*e*, and 141*f* may be the operation velocities of the boom cylinder 6 and the arm cylinder 7 rather than the rotational velocities of the boom 11 and the arm 12, and used as input to the geometric transformation sections 142*c*, 142*d*, 142*e*, and 142*f*.

—Work Point Selecting Section 150—

The work point selecting section 150 is a part that performs processing of selecting one velocity group in which all of the work point candidates 8*c* to 8*f* are least likely to perform an operation of entering the target surface 60 from among the plurality of velocity groups c to f formed by the candidate point velocity calculating section 140, and selecting the work point candidate associated with the selected velocity group as the work point (control point) of semiautomatic excavation and shaping control. Specifically, the work point selecting section 150 selects the velocity group in which all of the work point candidates 8*c* to 8*f* are least likely to perform an operation of entering the target surface 60 by selecting a velocity at which an entry into the target surface 60 is possibly made earliest (that is, a smallest velocity) in each of the plurality of velocity groups c to f, selecting a velocity at which an entry into the target surface 60 is possibly made latest (that is, a largest velocity) among the velocities at which an entry into the target surface 60 is possibly made earliest which velocities are selected from the plurality of velocity groups c to f, and selecting a velocity group to which the velocity at which an entry into the target surface 60 is possibly made latest belongs from among the plurality of velocity groups c to f. More detailed processing contents of the work point selecting section 150 will be described in the following.

Figure 17:
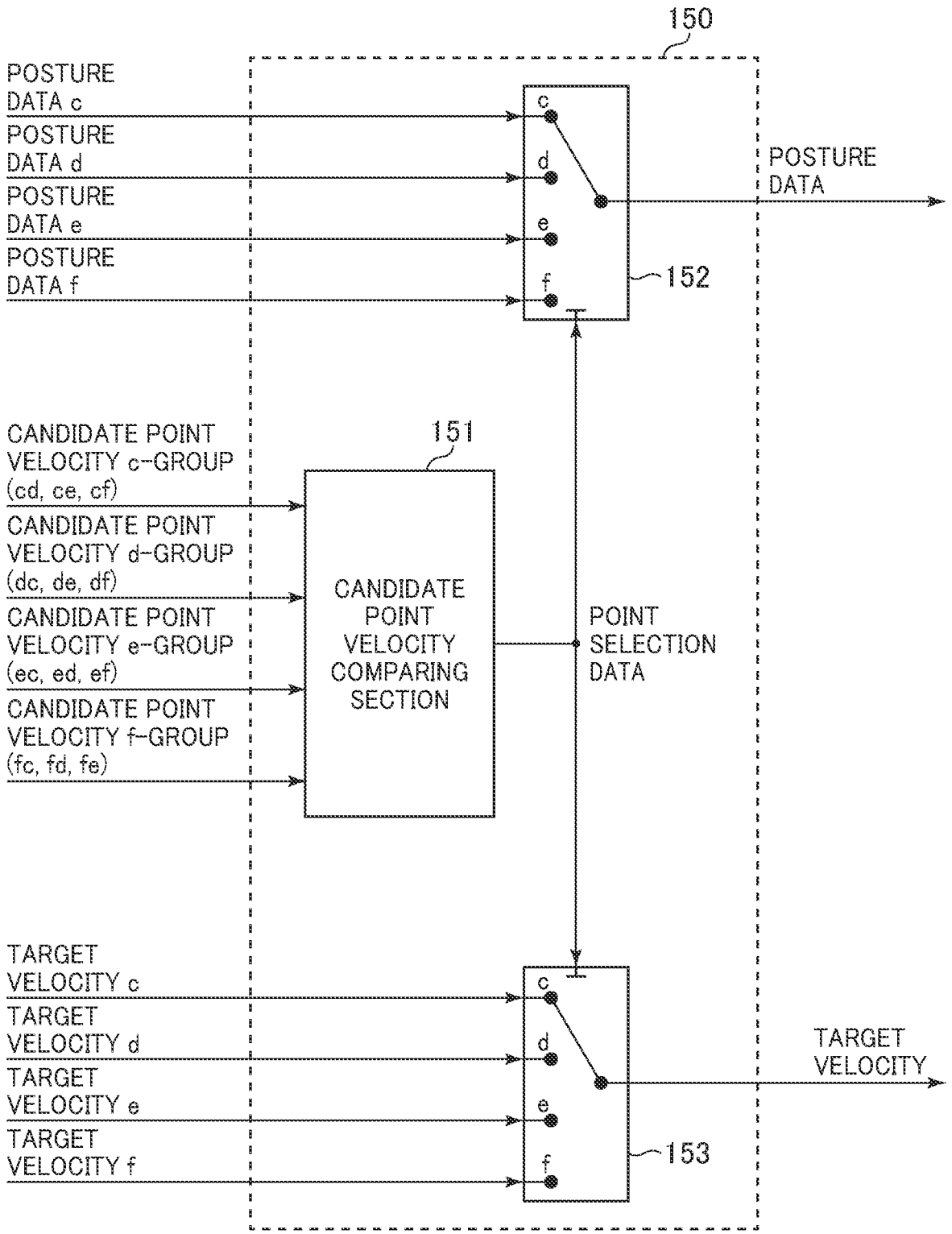
FIG. 17 is a block diagram depicting a detailed configuration of a work point selecting section in the second embodiment of the present invention.
Figure 18:
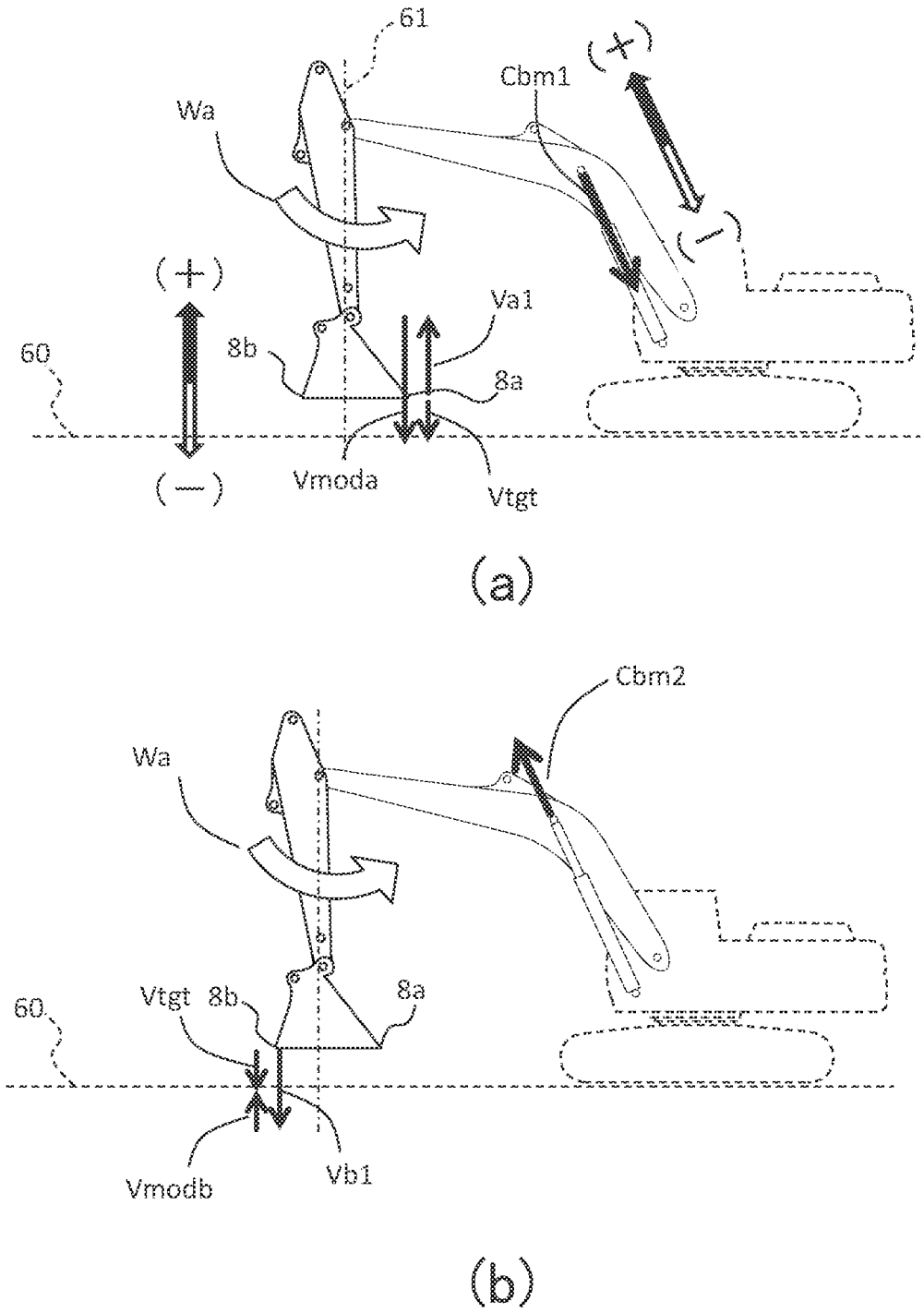
FIG. 18 is a diagram depicting velocity vectors at a time of horizontal surface excavation of the work machine.

FIG. 17 is a diagram depicting the work point selecting section 150 in the second embodiment. As in the first embodiment, the work point selecting section 150 includes a candidate point velocity comparing section 151, a posture data switching section 152, and a target velocity switching section 153.

First, the candidate point velocity comparing section 151 selects a minimum value (that is, a candidate point velocity at which an entry into the target surface 60 is possibly made earliest) in each of the candidate point velocities c to f. Thereby selected are a minimum value in the candidate point velocity c-group, a minimum value in the candidate point velocity d-group, a minimum value in the candidate point velocity e-group, and a minimum value in the candidate point velocity f-group. Next, the candidate point velocity comparing section 151 compares the minimum value in the candidate point velocity c-group, the minimum value in the candidate point velocity d-group, the minimum value in the candidate point velocity e-group, and the minimum value in the candidate point velocity f-group with each other, and selects a velocity group to which a maximum candidate point velocity belongs from among the four minimum values. Then, the candidate point velocity comparing section 151 sets the work point candidate associated with the selected velocity group as the work point. That is, the candidate point velocity comparing section 151 sets the bucket left tip end 8*c* as the work point when the maximum candidate point velocity is the minimum value in the candidate point velocity c-group, sets the bucket right tip end 8*d* as the work point when the maximum candidate point velocity is the minimum value in the candidate point velocity d-group, sets the bucket left back surface end 8*e* as the work point when the maximum candidate point velocity is the minimum value in the candidate point velocity e-group, and sets the bucket right back surface end 8*f* as the work point when the maximum candidate point velocity is the minimum value in the candidate point velocity f-group. The work point selecting section 150 then outputs point selection data indicating which of the four work point candidates 8*c* to 8*f* is selected. The candidate point velocity comparing section 151 outputs point selection data c for switching two 4-position switches (the posture data switching section 152 and the target velocity switching section 153) depicted in FIG. 17 to a position c when the bucket left tip end 8*c* is selected as the work point, outputs point selection data d for switching the same 4-position switches to a position d when the bucket right tip end 8*d* is selected as the work point, outputs point selection data e for switching the same 4-position switches to a position e when the bucket left back surface end 8*e* is selected as the work point, and outputs point selection data f for switching the same 4-position switches to a position f when the bucket right back surface end 8*f* is selected as the work point. FIG. 14 is a summary of these relations in a truth table.

The posture data switching section 152 outputs posture data PIc associated with the bucket left tip end 8*c* as posture data when the work point indicated by the point selection data is the bucket left tip end 8*c*, outputs posture data PId associated with the bucket right tip end 8*d* as posture data when the work point is the bucket back surface end 8*d*, outputs posture data PIe associated with the bucket left back surface end 8*e* as posture data when the work point is the bucket left back surface end 8*e*, and outputs posture data PIf associated with the bucket right back surface end 8*f* as posture data when the work point is the bucket right back surface end 8*f*.

The target velocity switching section 153 outputs the target velocity VTc associated with the bucket left tip end 8*c* as target velocity when the work point indicated by the point selection data is the bucket left tip end 8*c*, outputs the target velocity VTd associated with the bucket right tip end 8*d* as target velocity when the work point is the bucket back surface end 8*d*, outputs the target velocity VTe associated with the bucket left back surface end 8*e* as target velocity when the work point is the bucket left back surface end 8*e*, and outputs the target velocity VTf associated with the bucket right back surface end 8*f* as target velocity when the work point is the bucket right back surface end 8*f*.

The actuator velocity calculating section 130 geometrically calculates the target velocities of the boom cylinder 5, the arm cylinder 6, and the bucket cylinder 7 which target velocities are necessary to operate the work point at the target velocity, using the posture data and the target velocity output from the work point selecting section 150. The actuator velocity calculating section 130 then outputs the target velocities to the control valve driving section 200.

—Processing Flow of Controller 500—

Figure 15:
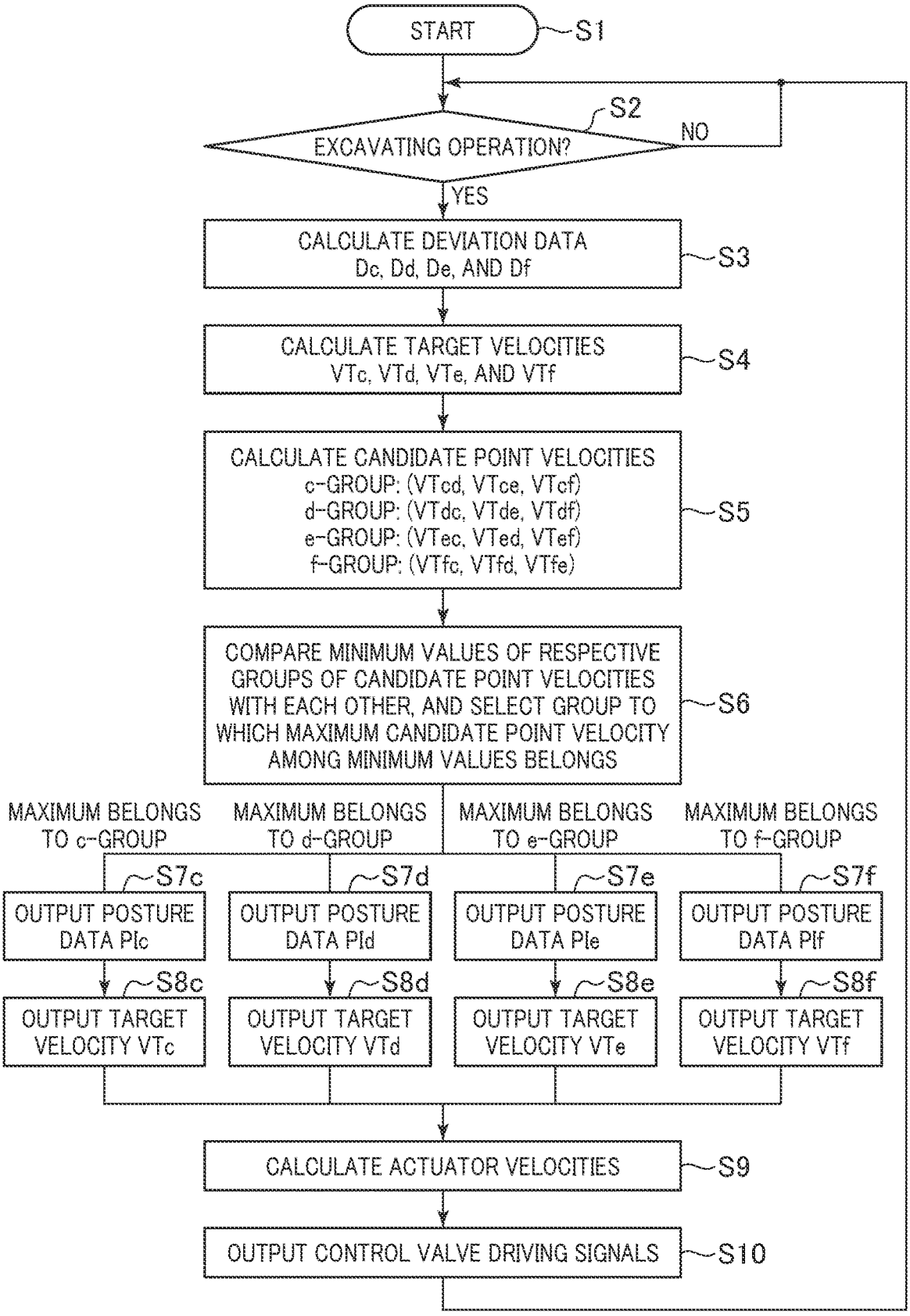
FIG. 15 is a flowchart depicting a flow of control in the second embodiment of the present invention.

FIG. 15 is a flowchart depicting a flow of calculation by the above-described controller 500. The controller 500 starts processing in a predetermined control cycle (step S1). The controller 500 determines whether or not the operation levers 1*c* and 1*d* are operated on the basis of input operation signals (step S2). Here, the processing proceeds to step S3 when the operation levers 1*c* and 1*d* are operated. The processing otherwise waits until the operation levers 1*c* and 1*d* are operated.

In step S3, the deviation calculating section 110 calculates deviation data Dc, Dd, De, and Df between the left and right tip ends 8*c* and 8*d* and the left and right back surface ends 8*e* and 8*d* of the bucket and the target surface 60 from the posture data PIc, PId, PIe, and PIf obtained from the posture sensors 13*a*, 13*b*, 13*c*, and 13*d* and the target surface data obtained from the target surface setting device 18.

In step S4, the target velocity calculating section 120 calculates the target velocities VTc, VTd, VTe, and VTf from the deviation data Dc, Dd, De, and Df, the posture data PIc, PId, PIe, and PIf, and the operation amount data obtained from the operation levers 1*c* and 1*d*.

In step S5, the candidate point velocity calculating section 140 calculates the candidate point velocities VTcd, VTce, VTcf, VTdc, VTde, VTdf, VTec, VTed, VTef, VTfc, VTfd, and VTfe, which are each the velocity of another work point candidate when one work point candidate 8*c*, 8*d*, 8*e*, or 8*f* is operated at the target velocity, from the target velocities VTc, VTd, VTe, and VTf and the posture data PIc, PId, PIe, and PIf. Here, the other three candidate point velocities VTcd, VTce, and VTcf when the work point candidate c is operated at the target velocity VTc are set as the candidate point velocity c-group, the other three candidate point velocities VTdc, VTde, and VTdf when the work point candidate d is operated at the target velocity VTd are set as the candidate point velocity d-group, the other three candidate point velocities VTec, VTed, and VTef when the work point candidate e is operated at the target velocity VTe are set as the candidate point velocity e-group, and the other three candidate point velocities VTfc, VTfd, and VTfe when the work point candidate f is operated at the target velocity VTf are set as the candidate point velocity f-group.

In step S6, the work point selecting section 150 compares minimum values in the respective groups of the candidate point velocities calculated in step S5 with each other, and selects, as the work point, the work point candidate corresponding to a candidate point velocity having a largest value among the minimum values. When the maximum value belongs to the c-group, the work point selecting section 150 selects the bucket left tip end 8*c* as the work point. The processing then proceeds to step S7*c*. When the maximum value belongs to the d-group, the work point selecting section 150 selects the bucket right tip end 8*d* as the work point. The processing then proceeds to step S7*d*. When the maximum value belongs to the e-group, the work point selecting section 150 selects the bucket left back surface end 8*e* as the work point. The processing then proceeds to step S7*e*. When the maximum value belongs to the f-group, the work point selecting section 150 selects the bucket right back surface end 8*f* as the work point. The processing then proceeds to step S7*f*.

In step S7*c*, the work point selecting section 150 outputs the posture data PIc related to the bucket left tip end 8*c* to the actuator velocity calculating section 130. In the following step S8*c*, the work point selecting section 150 outputs the target velocity VTc related to the bucket left tip end 8*c* to the actuator velocity calculating section 130. The processing then proceeds to step S9. Also in steps S7*d* to S7*f* and S8*d* to S8*f*, the posture data and the target velocities associated with the corresponding work points are similarly selected and output.

In step S9, the actuator velocity calculating section 130 receives, as input thereto, the posture data and the target velocity output by the work point selecting section 150, and calculates command values of the boom cylinder velocity, the arm cylinder velocity, and the bucket cylinder velocity corresponding to the posture data and the target velocity. The actuator velocity calculating section 130 outputs the command values to the control valve driving section 200. The processing then proceeds to step S10.

In step S10, the control valve driving section 200 generates the control valve driving signals corresponding to the boom cylinder velocity, the arm cylinder velocity, and the bucket cylinder velocity calculated in step S9, and outputs the control valve driving signals to the control valve 20 that controls the hydraulic cylinders 5, 6, and 7. The driving signals drive the control valve 20 to operate the respective hydraulic cylinders 5, 6, and 7. The work device 15 operates on the basis of the operation of the hydraulic cylinders 5, 6, and 7. It is thereby possible to prevent all of the four work point candidates 8*c* to 8*f* from entering the target surface 60.

—Action and Effect—

The hydraulic excavator according to the present embodiment configured as described above calculates the target velocities VTc to VTf respectively, on the basis of the deviation data Da to Df with respect to the target surface 60, for the four work point candidates 8*c* to 8*f* set to the work device 15, also calculates velocities (candidate point velocities) VTcd, VTce, VTcf, VTdc, VTde, VTdf, VTec, VTed, VTef, VTfc, VTfd, and VTfe occurring at three remaining work point candidates when each of the work point candidates 8*a* to 8*f* is moved at the target velocity VTa to VTf, and divides the 12 candidate point velocities into four groups (c-group to f-group) for the four respective work point candidates 8*c* to 8*f*. Then, a velocity at which an entry into the target surface 60 is possibly made earliest is selected in each of the four groups, one velocity at which an entry into the target surface 60 is possibly made latest is selected among the selected four velocities, and a work point candidate associated with a velocity group to which the velocity at which an entry is possibly made latest belongs is selected as the work point. When the work point is thus selected, the remaining work point candidates not selected as the work point among the four work point candidates 8*c* to 8*f* can also be prevented from entering the target surface 60. Thus, also for a target surface located at a position from which the work point candidates 8*c* to 8*f* are separated by boom lowering, the plurality of work point candidates 8*c* to 8*f* on the work device 15 can be prevented from entering the target surface 60. It is thereby possible to improve accuracy and efficiency of work by the hydraulic excavator.

In addition, in the present embodiment, the plurality of work point candidates are present in the direction of a rotational axis of the work device 15 (for example, the axial direction of a boom pin). Thus, semiautomatic excavation and shaping can be performed also on a target surface 60 not uniform in the direction of the rotational axis of the work device 15 (for example, a target surface not parallel with the rotational axis of the work device 15) while the tip end edges and the back edges of the bucket are prevented from entering the target surface 60.

<Others>

The present invention is not limited to the foregoing embodiments, but includes various modifications within a scope not departing from the spirit of the present invention. For example, the present invention is not limited to including all of the configurations described in the foregoing embodiments, but includes configurations obtained by omitting a part of the configurations. In addition, a part of a configuration according to a certain embodiment can be added to or replaced with a configuration according to another embodiment.

For example, while in the first and second embodiments, the work device 15 is constituted of the boom 11, the arm 12, and the bucket 8, which each have a rotational axis in a same direction, the work device 15 may be other than this. As an example, there is a bucket having a rotary rotational axis or a tilt rotational axis or the like. In addition, while the four work point candidates are vertices of the perimeter of the bucket (vertices of four sides constituting the bottom surface of the bucket) in the second embodiment, a work point candidate may be further added to at least one of the four sides constituting the bottom surface of the bucket (excluding the vertices), and in work on an uneven target surface 60, for example, the work point candidate set to one of the four sides may be prevented from coming into contact with a projecting portion of the target surface 60.

In the foregoing embodiments, description has been made of cases where the number of work point candidates is two and four. However, it is needless to say that the present invention is applicable also to cases where the number of work point candidates is three or five or more.

In addition, the above description has been made of a case where the target surface is set in the machine body coordinate system. However, semiautomatic excavation and shaping control can be performed on a target surface set in a geographic coordinate system by, for example, mounting two GNSS antennas and a receiver on the upper swing structure 10 of the hydraulic excavator and thereby making it possible to calculate the position and orientation of the hydraulic excavator in the geographic coordinate system. The same is true for coordinate systems other than the machine body coordinate system and the geographic coordinate system.

In addition, in the above description, only the boom cylinder 5 is set as a target of semiautomatic control.

However, the arm cylinder 6 and the bucket cylinder 7 may be set as a target of semiautomatic control.

A part or the whole of each configuration of the controller 500 described above and functions, execution processing, and the like of each such configuration may be implemented by hardware (for example, by designing logic for performing each function by an integrated circuit). In addition, the configurations of the controller 500 described above may be a program (software) that implements each function of the configurations of the controller 5005 by being read and executed by a calculation processing device (for example, a CPU). Data related to the program can be stored in, for example, a semiconductor memory (a flash memory, an SSD, or the like), a magnetic storage device (a hard disk drive or the like), a recording medium (a magnetic disk, an optical disk, or the like), and the like. In addition, a system may be configured such that a plurality of controllers or computers perform distributed processing of a part or the whole of the processing performed by the controller 500.

DESCRIPTION OF REFERENCE CHARACTERS

1*a*: Travelling right operation lever
1*b*: Travelling left operation lever
1*c*: Right operation lever
1*d*: Left operation lever
2: Hydraulic pump
3*a*: Right travelling hydraulic motor
3*b*: Left travelling hydraulic motor
4: Swing hydraulic motor
5: Boom cylinder (hydraulic actuator)
6: Arm cylinder (hydraulic actuator)
7: Bucket cylinder (hydraulic actuator)
8: Bucket
8*a*: Bucket tip end
8*b*: Bucket back surface end
8*c*: Bucket left tip end
8*d*: Bucket right tip end
8*e*: Bucket left back surface end
8*f*: Bucket right back surface end
9: Lower travel structure
10: Upper swing structure
11: Boom
12: Arm
13*a*: First posture sensor (posture sensor)
13*b*: Second posture sensor (posture sensor)
13*c*: Third posture sensor (posture sensor)
13*d*: Machine body posture sensor (posture sensor)
14: Prime mover
15: Work device
18: Target surface setting device
20: Control valve
100: Information processing section
110: Deviation calculating section
120: Target velocity calculating section
130: Actuator velocity calculating section
140: Candidate point velocity calculating section
141*a*: Geometric inverse transformation section
141*b*: Geometric inverse transformation section
141*c*: Geometric inverse transformation section
141*d*: Geometric inverse transformation section
141*e*: Geometric inverse transformation section
141*f*: Geometric inverse transformation section
142*a*: Geometric transformation section
142*b*: Geometric transformation section
142*c*: Geometric transformation section
142*d*: Geometric transformation section
142*e*: Geometric transformation section
142*f*: Geometric transformation section
150: Work point selecting section
151: Candidate point velocity comparing section
152: Posture data changing section
153: Target velocity changing section
200: Control valve driving section
500: Controller

The invention claimed is:

1. A work machine comprising:

a work device;

a hydraulic cylinder driven by a hydraulic operating oil delivered from a hydraulic pump thereby driving the work device;

an operation device that gives instructions on operations of the hydraulic cylinder according to operation by an operator; and a controller configured to calculate respective target velocities of the hydraulic cylinder for moving a plurality of work point candidates along an optionally set target surface, the work point candidates being set to the work device, on a basis of positional data of the target surface, posture data of the work device, and operation data of the operation device, and control a velocity of the hydraulic cylinder according to one of a plurality of the calculated target velocities;

wherein the controller calculates at least one candidate point velocity that occurs at at least one remaining work point candidate among the plurality of work point candidates in a case where each of the plurality of work point candidates is moved at a corresponding target velocity among the plurality of target velocities, creates a plurality of velocity groups by grouping the at least one candidate point velocity for each of the plurality of work point candidates, selects one velocity group from among the plurality of work point candidates, the one velocity group in which all of the plurality of work point candidates are least likely to perform an operation of entering the target surface, and controls the hydraulic cylinder according to a target velocity, among the plurality of target velocities, of a work point candidate associated with the selected one velocity group.

2. The work machine according to claim 1, wherein the controller calculates the at least one candidate point velocity that occurs at the at least one remaining work point candidate among the plurality of work point candidates in the case where each of the plurality of work point candidates is moved at the corresponding target velocity among the plurality of target velocities, creates the plurality of velocity groups by grouping the at least one candidate point velocity for each of the plurality of work point candidates, selects a plurality of candidate point velocities that are velocities at which entries of the work device into the target surface are possibly made earliest among candidate point velocities included in each of the plurality of velocity groups, selects a velocity, from among the plurality of candidate point velocities, at which an entry of the work device into the target surface is possibly made latest among the plurality of candidate point velocities, selects one velocity group to which the velocity at which the entry of the work device into the target surface is possibly made latest belongs, from among the plurality of velocity groups, and controls the hydraulic cylinder according to a target velocity of a work point candidate associated with the selected one velocity group among the plurality of target velocities.

3. The work machine according to claim 2, wherein when a velocity direction of moving away from the target surface is assumed to be positive, the velocity at which an entry into the target surface is possibly made earliest is a smallest velocity, and the velocity at which an entry into the target surface is possibly made latest is a largest velocity.

4. The work machine according to claim 1, wherein a first work point candidate and a second work point candidate are set as the plurality of work point candidates to the work device, and the controller calculates a first candidate point velocity as a velocity occurring in a case where the second work point candidate is moved at the target velocity of the second work point candidate among the plurality of target velocities, the velocity occurring at the first work point candidate, calculates a second candidate point velocities as a velocity occurring in a case where the first work point candidate is moved at the target velocity of the first work point candidate among the plurality of target velocities, the velocity occurring at the second work point candidate, controls the hydraulic cylinder according to the target velocity of the second work point candidate when the first candidate point velocity is a velocity at which an entry into the target surface is less likely than the second candidate point velocity, and controls the hydraulic cylinder according to the target velocity of the first work point candidate when the second candidate point velocity is a velocity at which an entry into the target surface is less likely than the first candidate point velocity.

5. The work machine according to claim 4, wherein the work device has a bucket, the first work point candidate is a point set on a tip end edge of the bucket, and the second work point candidate is a point set on a back surface end edge of the bucket.

* * * * *